US007201150B2

(12) United States Patent
Oono

(10) Patent No.: US 7,201,150 B2
(45) Date of Patent: Apr. 10, 2007

(54) ENERGY-SAVING HIGH-PRESSURE FUEL SUPPLY CONTROL DEVICE FOR INTERNAL COMBUSTION ENGINE

(75) Inventor: Takahiko Oono, Hyogo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 11/498,732

(22) Filed: Aug. 4, 2006

(65) Prior Publication Data

US 2007/0034191 A1 Feb. 15, 2007

(30) Foreign Application Priority Data

Aug. 10, 2005 (JP) ..... P2005-231961

(51) Int. Cl.
*F02M 37/04* (2006.01)

(52) U.S. Cl. ..... 123/506; 123/500; 123/456

(58) Field of Classification Search ..... 123/506, 123/500, 501, 446, 447, 514, 458, 456
See application file for complete search history.

(56) References Cited

U.S. PATENT DOCUMENTS 4,630,588 A * 12/1986 Sagawa et al. ..... 123/506
4,766,864 A * 8/1988 Ban et al. ..... 123/357
4,793,313 A * 12/1988 Paganon et al. ..... 123/506
5,271,366 A * 12/1993 Shimada et al. ..... 123/300
5,485,822 A * 1/1996 Hirose et al. ..... 123/501
7,063,073 B2 * 6/2006 Ausiello et al. ..... 123/446
2002/0117154 A1 * 8/2002 Inoue et al. ..... 123/506

FOREIGN PATENT DOCUMENTS

JP 08-303325 A 11/1996
JP 2002-188545 A 7/2005

* cited by examiner

*Primary Examiner*—Carl S. Miller
(74) *Attorney, Agent, or Firm*—Sughrue Mion, PLLC

(57) ABSTRACT

In an energy-saving high-pressure fuel supply control device for sucking a low-pressure fuel via a flow rate control valve and supplying high-pressure fuel acquired by pressurizing the sucked fuel to a fuel rail, at a time point that is logically decided from a bottom dead center and at which the pressure of the high-pressure fuel rises to a pressure to hold closing of the flow rate control valve, energization of the flow rate control valve is ended to restrain energization energy to the flow rate control valve. The time point when the energization of the flow rate control valve is ended is deviated toward lag side in advance by a time that causes deviation of the bottom dead center of the plunger toward the lag side from the original bottom dead center.

14 Claims, 14 Drawing Sheets

ENERGY-SAVING HIGH-PRESSURE FUEL SUPPLY CONTROL DEVICE FOR INTERNAL COMBUSTION ENGINE

BACKGROUND OF THE INVENTION

1. Field of the Invention

This invention relates to a high-pressure fuel supply control device for internal combustion engine that injects fuel into each cylinder while controlling the fuel pressure within a fuel rail at a target value, and particularly to an energy-saving high-pressure fuel supply control device that limits the time of energizing a flow rate control valve.

2. Description of the Related Art

Recently, in order to reduce exhaust gas, internal combustion engines that control the fuel pressure within a fuel rail to a high pressure and inject fuel particles have been proposed (see, for example, Patent References 1 and 2).

The configuration of a fuel system in an internal combustion engine of this type will be described hereinafter.

A high-pressure fuel pump for maintaining fuel at a high pressure has a plunger that reciprocates in a pressurizing chamber. The lower end of the plunger is pressed in contact with a pump cam provided on a cam shaft of an internal combustion engine. Thus, when the pump cam rotates as it is interlocked with the cam shaft, the plunger reciprocates in the pressurizing chamber, increasing and decreasing the capacity of the pressurizing chamber.

An ejection path on the downstream side of the pressurizing chamber is connected to a fuel rail via an ejection valve that only allows circulation of fuel moving from the pressurizing chamber toward the fuel rail. The fuel rail holds the fuel ejected from the pressurizing chamber and distributes the fuel to a fuel injection valve.

A low-pressure path on the upstream side of the pressurizing chamber is connected to a fuel tank via a normally-open flow rate control valve, a low-pressure fuel pump and low-pressure pressure regulator. The fuel drawn up to the low-pressure path from the low-pressure fuel pump is regulated to a predetermined low pressure value by the low-pressure pressure regulator. After that, the fuel is sucked into the pressurizing chamber through the open flow rate control valve during a period when the plunger moves downward from a top dead center to a bottom dead center (i.e., a period when the capacity of the pressurizing chamber increases).

Meanwhile, if the flow rate control valve is closed during a period when the plunger moves upward from the bottom dead center to the top dead center (i.e., a period when the capacity of the pressurizing chamber decreases), a maximum quantity of fuel pressurized in the pressurizing chamber is supplied to the fuel rail by the upward movement of the plunger.

Conversely, if the flow rate control valve is not closed at all during the period when the plunger moves upward from the bottom dead center to the top dead center, the fuel sucked in the pressurizing chamber is relieved to the low-pressure path and no fuel is supplied to the fuel rail.

If the flow rate control valve is closed at a certain point in the period when the plunger moves upward from the bottom dead center to the top dead center, a part of the fuel sucked in the pressurizing chamber is relieved to the low-pressure path while the plunger moves from the bottom dead to the closing position of the flow rate control valve, and the fuel left in the pressurizing chamber is pressurized and supplied to the fuel rail while the plunger moves from the closing position of the flow rate control valve to the top dead center.

In this manner, by controlling the closing of the flow rate control valve at arbitrary timing in the period when the plunger moves upward, it is possible to adjust the quantity of fuel to be supplied to the fuel rail between the maximum quantity and the minimum quantity.

Hereinafter, referring to the time chart of FIG. 14, a supplementary explanation is given with respect to the relation between the closing position of the flow rate control valve and the quantity of fuel ejection in the period when the plunger moves upward from the bottom dead center BDC to the top dead center TDC.

FIG. 14 shows the relation between, from the top, the operating position of the plunger, the energization timing for a solenoid, the open/close state of the flow rate control vale, the internal pressure in the pressurizing chamber and the closing position of the flow rate control valve, and the quantity of fuel ejection. FIG. 14 also shows an operation in the case where the closing position of the flow rate control valve is decided at a time point of TVC, as an example.

An electronic control unit (ECU) as a control unit specifies a plunger bottom dead center reaching position BDC on the basis of the detected rotating position of the internal combustion engine and decides a time point that is Tr-time after the time point of the plunger bottom dead center reaching position BDC, as a time point of target valve closing position TVC of the flow rate control valve.

To close the flow rate control valve at the time point TVC, energization start timing TON and energizing end timing TOFF for the solenoid that drives the flow rate control valve are controlled.

There is an operating lag time (hereinafter referred to as pre-energization time Tp) from the start of the energization of the solenoid until the completion of the closing of the flow rate control valve. Thus, the energization of the solenoid is started at the time point TON that precedes the time point of the target valve closing position TVC by the pre-energization time Tp. Since this pre-energization time Tp changes depending mainly on the electric energy supplied to the solenoid, the pre-energization time Tp is stored in advance in the memory of the ECU as data for each battery voltage. When actually energizing the solenoid, the pre-energization time Tp is set in accordance with the detected battery voltage. This enables accurate control of the closing position of the flow rate control valve even when the battery voltage differs.

As the pre-energization time Tp passes and after the flow rate control valve is closed at the time point of the target valve closing position TVC, the fuel in the pressurizing chamber is pressurized by the upward movement of the plunger and the fuel pressure itself in the pressurizing chamber acts as a sufficient physical energization force to close the flow rate control valve. This physical energization force to close the valve continues to the plunger top dead center TDC where reduction in the pressure in the pressurizing chamber starts. Therefore, after the flow rate control valve is close and then the pressure of the fuel in the pressurizing chamber rises to a pressure Pa or higher to act as a sufficient physical energization force to close the flow rate control valve, the closing state of the flow rate control valve can be maintained up to the plunger top dead center TDC without continuing the application of an electromagnetic force to close the valve by the energization of the solenoid.

Thus, in the conventional technique, the time (hereinafter referred to as basic energization time Tbase) from the time point when the flow rate control valve is closed until the fuel pressure itself in the pressurizing chamber rises to the pressure Pa or higher to act as a physical energization force to close the flow rate control valve is stored in advance in the memory of the ECU, and this is set as a hold energization time Th (=basic energization time Tbase). This keeps the hold energization time Th to a minimum necessary time, thereby reducing the power consumption (see Patent Reference 2).

As a result, in the period from the time point of the plunger bottom dead center BDC to the time point TVC when the closing of the flow rate control valve is completed (i.e., period Tr in FIG. 14), a part (=QR) of the fuel (=QMAX) sucked in the pressurizing chamber when the plunger moves downward is relieved to the low-pressure path through the open flow rate control valve.

On the other hand, in the period from the time point TVC where the closing of the flow rate control valve is completed to the time point of the plunger top dead center TDC (i.e., period To in FIG. 14), since the flow rate control valve has been closed, the fuel (=QMAX−QR) left in the pressurizing chamber when the flow rate control valve is closed is pressurized and supplied to the fuel rail through the ejection valve.

Meanwhile, for example, if the same position as the plunger bottom dead center BDC is defined as the target valve closing position TVC, that is, if Tr=0 is set, the flow rate control valve is closed during the entire period of the plunger upward movement, and all the fuel (=QMAX) sucked in the pressurizing chamber when the plunger moves downward is pressurized and supplied to the fuel rail as the maximum quantity of fuel ejection (=QMAX).

If the solenoid is not energized at all, the flow rate control valve is left open during the entire period of the plunger upward movement. All the fuel (=QMAX) sucked in the pressurizing chamber when the plunger moves downward is relieved to the low-pressure path, and the pressurized fuel is not supplied to the fuel rail at all. Thus, the quantity of fuel ejection is zero.

In this manner, by varying the closing position of the flow rate control valve between the plunger bottom dead center BDC and the plunger top dead center TDC, it is possible to adjust the quantity of ejected fuel to be supplied to the fuel rail between the maximum quantity (QMAX) and the minimum quantity (zero).

The ECU decides a target fuel pressure in accordance with the engine operation state such as the number of rotations of the internal combustion engine and the quantity of depression of the accelerator pedal, and performs PID calculation based on the pressure difference between the target fuel pressure and the actual fuel pressure in the fuel rail, thus finding the quantity of fuel to be supplied to the fuel rail. The ECU then decides the time (or angle) Tr from the time point of the plunger bottom dead center reaching position BDC based on the characteristics of the quantity of fuel ejection with respect to the closing position of the flow rate control valve (see FIG. 14), and controls the target valve closing position.

Next, the control operation when ejecting the maximum quantity of fuel from the high-pressure fuel pump will be described in detail with reference to a time chart drawn by solid lines in FIG. 15.

FIG. 15 is a time chart showing, from the top, a reference signal REF generated on the basis of the rotating position of the internal combustion engine, the operating position of the plunger, the energization timing for the solenoid, the open/close state of the flow rate control valve, and the internal pressure in the pressurizing chamber.

In FIG. 15, the ECU first generates the reference signal REF indicating a predetermined rotating position in the rotation phase of the internal combustion engine.

The positional relation between the position of the reference signal REF and the subsequent plunger bottom dead center reaching position BDC is stored in advance as a design value in the ECU. A time point that is later than the reference signal RED by an offset value Td equivalent to a predetermined time period (or predetermined angle) is specified as a normal plunger bottom dead center BDC reaching position (hereinafter referred to as estimated bottom dead center BDC). That is, the plunger operation indicated by a solid line in FIG. 15 is recognized as a normal plunger operating position. Therefore, when ejecting the maximum quantity of fuel, the target valve closing position TVC is decided at the same position as the estimated bottom dead center BDC (i.e., Tr=0).

The pre-energization time Tp according to the battery voltage and the hold energization time Th (=basic energization time Tbase) are set. The energization of the solenoid is started at the time point TON that precedes the time point of the target valve closing position TVC by the pre-energization time Tp. The energization of the solenoid is ended at the time point TOFF when the hold energization time Th (=Tbase) has passed from the time point of the target valve closing position TVC (i.e., time point when the internal pressure in the pressurizing chamber reaches Pa or higher).

As a result, as shown by the open/close state of the flow rate control valve indicated by a solid line, the flow rate control valve is closed at the position of the estimated bottom dead center BDC and the fuel in the pressurizing chamber is pressurized during the entire period up to the time point of the top dead center TDC reaching position. Thus, the maximum quantity of fuel is supplied to the fuel rail.

The ECU performs PID calculation based on the pressure difference between the target fuel pressure decided in accordance with the engine operating state and the actual fuel pressure in the fuel rail and performs feedback control of the target valve closing position TVC of the flow rate control valve. Therefore, when the actual fuel pressure is significantly lowered from the target fuel pressure or a similar situation occurs, the quantity of feedback correction becomes excessively large. The target valve closing position TVC may move too much toward the advance side from the estimated bottom dead center BDC and the quantity of ejection may become uncontrollable.

Thus, in the conventional technique, an advance limit value LIM (=Lbase) is provided at the same position as the estimated bottom dead center BDC to prevent the movement the target valve closing position TVC from moving over the estimated bottom dead center BDC toward the advance side (see claim 2 in Patent Reference 1).

Patent Reference 1: JP-A-2002-188545 (FIGS. 5, 9 and 11 and the description of these drawings)

Patent Reference 2: JP-A-8-303325 (FIGS. 2 to 4 and the description of these drawings)

If the positional relation between the reference signal REF and the subsequent estimated bottom dead center BDC is coincident with the preset value stored in advance in the ECU (i.e., offset value Td), there is no problem in supplying the maximum quantity of fuel from the high-pressure fuel pump to the fuel rail.

However, in the actual control device, it may be considered that, for example, the positional relation between the reference signal REF and the subsequent estimated bottom dead center BDC is deviated from the normal relation because of some variations in the members concerning the position control, including the mounting position of the cam angle sensor that detects the rotating position and the high-pressure fuel pump, the processing accuracy of the pump cam and the like. The positional relation may also be deviated as the device is used for years.

However, the conventional technique does not take particular measures to deal with such variations and therefore has a potential problem as follows.

Hereinafter, a problem in the state where the members concerning the position control vary will be described with reference to FIGS. 15 and 16.

FIGS. 15 and 16 are time charts showing, from the top, the reference signal REF generated on the basis of the rotating position of the internal combustion engine, the operating position of the plunger, the energization timing for the solenoid, the open/close sate of the flow rate control valve, and the internal pressure in the pressurizing chamber.

FIG. 15 shows two control operations, that is, control operation in the case where the plunger is operating at normal timing (solid line) and control operation in the case where the plunger has a maximum deviation toward the lag side (single-dotted chain line). FIG. 16 shows two control operations, that is, control operation in the case where the plunger is operating at normal timing (solid line) and control operation in the case where the plunger has a maximum deviation toward the advance side (double-dotted chain line).

In FIG. 15, an actual bottom dead center BDC1 in the case where the plunger operating position has a maximum deviation toward the lag side (single-dotted chain line) is reached with a lag of Trtd (toward the lag side) from a bottom dead center in the case where the plunger is operating at normal timing (solid line) (that is, estimated bottom dead center BDC).

However, the ECU, which has not detected the deviation in the plunger operating position, assumes that the plunger is at the normal operating position. Then, the ECU specifies a time point that is after the lapse of an offset value Td from the reference signal REF, as the estimated bottom dead center BDC, and sets the advance limit value LIM=Lbase at the same position as the estimated bottom dead center BDC. The ECU thus controls the target valve closing position TVC (that is, Tr=0).

Therefore, when supplying the maximum quantity of fuel ejection to the fuel rail, the target valve closing position TVC is decided at the same position as the estimated bottom dead center BDC. Then, the pre-energization time Tp and the hold energization time Th (=basic energization time Tbase) are set. The energization of the solenoid is started at a time point TON that precedes the time point of the target valve closing position TVC by the pre-energization time Tp. At a time point TOFF that is after the lapse of the hold energization time Th (=Tbase) from the time point of the target valve closing position TVC, the energization of the solenoid is ended.

However, because of the deviation in the plunger operating position, the actual bottom dead center BDC1 is reached with a lag of Trtd (toward the lag side) from the estimated bottom dead center BDC. Therefore, in the worst case, the energization of the solenoid is ended before the actual bottom dead center BDC1 is reached, as shown in the example of FIG. 15, and the basic energization time Tbase in which the solenoid should be energized after closing the valve during the upward movement of the plunger cannot be secured. The fuel may pass while the flow rate control valve is left open during the upward movement of the plunger (see the open/close operation of the flow rate control valve indicated by a single-dotted chain line in FIG. 15). As a result, the fuel sucked in the pressurizing chamber is relieved to the low-pressure path through the flow rate control valve that is left open, and the fuel is not supplied to the fuel rail. The fuel pressure in the fuel rail is deviated from the target fuel pressure, causing a problem of significant deterioration in drivability and exhaust gas.

On the other hand, in FIG. 16, an actual bottom dead center BDC2 in the case where the plunger operating position has a maximum deviation toward the advance side (double-dotted chain line) is reached earlier (toward the advance side) by Tadv from the estimated bottom dead center BDC in the case where the plunger is operating at normal timing (solid line).

However, the ECU, which has not detected the deviation in the plunger operating position, assumes that the plunger is at the normal operating position. Then, the ECU specifies a time point that is after the lapse of an offset value Td from the reference signal REF, as the estimated bottom dead center BDC, and sets the advance limit value LIM=Lbase at the same position as the estimated bottom dead center BDC. The ECU thus controls the target valve closing position TVC (that is, Tr=0).

Therefore, when supplying the maximum quantity of fuel ejection to the fuel rail, the target valve closing position TVC is decided at the same position as the estimated bottom dead center BDC. Then, the pre-energization time Tp and the hold energization time Th (=basic energization time Tbase) are set. The energization of the solenoid is started at a time point TON that precedes the time point of the target valve closing position TVC by the pre-energization time Tp. At a time point TOFF that is after the lapse of the hold energization time Th (=Tbase) from the time point of the target valve closing position TVC, the energization of the solenoid is ended.

However, because of the deviation in the plunger operating position, the actual bottom dead center BDC2 is reached earlier (toward the advance side) by Tadv from the estimated bottom dead center BDC. Therefore, the valve closing control is performed, assuming the time point that is later (toward the lag side) by Tadv from the actual bottom dead center BDC2 as the target valve closing position TVC.

As a result, in the period Tadv from the time point of the actual bottom dead center BDC2 to the time point of the target valve closing position TVC, a part of the fuel sucked in the pressurizing chamber is relieved to the low-pressure path, and only the fuel left in the pressurizing chamber at the time point of the target valve closing position TVC when the flow rate control valve is closed (i.e., fuel less than the maximum quantity of fuel ejection) is pressurized until the time point of the actual top dead center TDC2 and supplied to the fuel rail. Therefore, the fuel pressure is deviated from the target fuel pressure, causing a problem of significant deterioration in drivability and exhaust gas.

SUMMARY OF THE INVENTION

In view of the foregoing problems, it is an object of this invention to provide an energy-saving high-pressure fuel supply control device for internal combustion engine that enables supply of a desired quantity of fuel ejection to the fuel rail even if variations related to the position control of the flow rate control valve occur when attempting to perform ejection control of the maximum quantity of fuel.

An energy-saving high-pressure fuel supply control device for internal combustion engine according to a first aspect of this invention includes: a high-pressure fuel pump that has a plunger driven to reciprocate by a pump cam interlocked with an internal combustion engine, sucks low-pressure fuel via a flow rate control valve during a movement of the plunger from a top dead center toward a bottom dead center, pressurizes the sucked fuel during a movement of the plunger from the bottom dead center toward the top dead center, and supplies the high-pressure fuel provided by the pressurization, to a fuel rail; and an electronic control unit that performs energization control to the flow rate control valve. At a time point that is logically determined from the time point of the bottom dead center and when the pressure of the high-pressure fuel rises to a pressure to hold closing of the flow rate control valve, the electronic control unit ends the energization of the flow rate control valve to restrain energization energy to the flow rate control valve. The time point when the energization of the flow rate control valve is ended is deviated toward lag side in advance by a time that causes deviation of the bottom dead center of the plunger toward the lag side from the original bottom dead center.

DETAILED DESCRIPTION OF THE PREFERRED EMBODIMENTS

Embodiment 1

Figure 1:
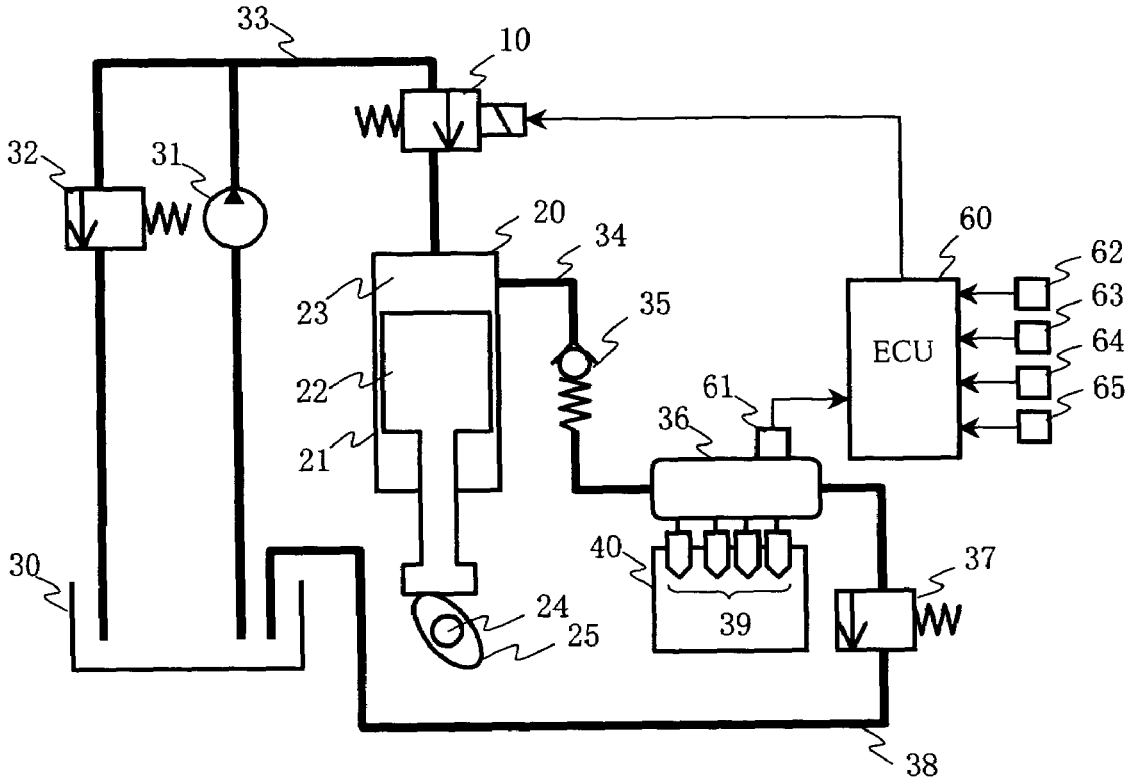
FIG. 1 is a block configurational view showing an example of a high-pressure fuel pump control device for internal combustion engine according to Embodiment 1 of this invention.

Hereinafter, a high-pressure fuel pump control device for internal combustion engine according to Embodiment 1 of this invention will be described with reference to the drawings. FIG. 1 is a block configurational view showing the high-pressure fuel pump control device for internal combustion engine according to Embodiment 1 of this invention.

In FIG. 1, a high-pressure pump 20 for pressurizing fuel to a high pressure includes a cylinder 21, a plunger 22 that reciprocates in the cylinder 21, and a pressurizing chamber 23 formed by partitioning by the inner circumferential wall of the cylinder 21 and the upper end surface of the plunger 22.

The lower end of the plunger 22 is pressed in contact with a pump cam 25 provided on a cam shaft 24 of an internal combustion engine 40. As the pump cam 25 rotates interlocked with the rotation of the cam shaft 24, the plunger 22 reciprocates in the cylinder 21, increasing and decreasing the capacity of the pressurizing chamber 23.

A low-pressure path 33 connected upstream of the pressurizing chamber 23 is connected to a fuel tank 30 via a low-pressure fuel pump 31.

The low-pressure fuel pump 31 draws up fuel in the fuel tank 30 and ejects the fuel to the low-pressure path 33.

The fuel ejected from the low-pressure fuel pump 31 is regulated to a predetermined low pressure value by a low-pressure pressure regulator 32. After that, the fuel is fed into the pressurizing chamber 23 via a normally-open flow rate control valve 10 when the plunger 22 moves downward in the cylinder 21.

Meanwhile, a supply path 34 connected downstream of the pressurizing chamber 23 is connected to a fuel rail 36 via an ejection valve 35. The ejection valve 35 is a non-return valve that only allows circulation of the fuel from the pressurizing chamber 23 toward the fuel rail 36.

The fuel rail 36 stores and holds the high-pressure fuel ejected from the pressurizing chamber 23. Also, the fuel rail 36 is connected commonly to each fuel injection valve 39 and distributes the fuel to the fuel injection valves 39.

A relief valve 37 connected to the fuel rail 36 is formed by a normally-closed valve that opens at or above a predetermined valve opening pressure. The relief valve 37 opens when the fuel pressure in the fuel rail 36 is rising to or above a preset valve opening pressure value of the relief valve 37.

Thus, the fuel in the fuel rail 36 with its pressure rising to or above the preset valve opening pressure value is returned to the fuel tank 30 through a relief path 38, thus preventing the fuel pressure in the fuel rail 36 from getting excessively high.

The flow rate control valve 10, formed by a normally-open electromagnetic valve, is provided in the low-pressure path 33 connecting the low-pressure fuel pump 31 to the pressurizing chamber 23. The closing of the flow rate control valve 10 is drive-controlled under the control of an ECU 60, thus regulating the quantity of fuel ejection QO from the high-pressure fuel pump 20 to the fuel rail 36.

In the high-pressure fuel pump 20, when the plunger 22 moves upward in the cylinder 21 (when the capacity of the pressurizing chamber 23 decreases), the fuel sucked in the pressurizing chamber 23 is returned from the pressurizing chamber 23 to the low-pressure path 33 via the flow rate control valve 10 while the flow rate control valve 10 is controlled to open.

Therefore, while the flow rate control valve 10 is controlled to open, the high-pressure fuel is not supplied to the fuel rail 36.

On the other hand, after the flow rate control valve 10 is controlled to close at predetermined timing in the upward movement of the plunger 22 in the cylinder 21, the pressurized fuel ejected from the pressurizing chamber 23 to the ejection path 34 is supplied to the fuel rail 36 via the ejection valve 35.

The ECU 60 acquires various driving information including the fuel pressure in the fuel rail 36 detected by a fuel pressure sensor 61, the rotation speed and the rotating position of the crank shaft of the internal combustion engine 40 detected by a crank angle sensor 62, the rotating position of the cam shaft 24 of the internal combustion engine 40 detected by a cam angle sensor 63, the quantity of depression of an accelerator pedal (not shown) detected by an accelerator position sensor 64, and the battery voltage detected by a battery voltage detecting unit 65.

The ECU 60 decides a target fuel pressure based on the detected information from the crank angle sensor 62 and the accelerator position sensor 64, and performs feedback control of the driving timing of a solenoid 14 of the flow rate control valve 10 so that the fuel pressure in the fuel rail 36 coincides with the target fuel pressure, thus controlling the quantity of fuel ejection.

Next, an exemplary internal structure of the flow rate control valve 10 shown in FIG. 1 will be described with reference to the longitudinal sectional views of FIGS. 2A and 2B.

FIG. 2A shows a state where the solenoid 14 is not energized, and FIG. 2B shows a state where the solenoid 14 is energized (excited for driving). The flow rate control valve 10 includes a flow rate control valve plunger 11, a valve body 12 interlocked with the flow rate control valve plunger 11, a compressed spring 13 that physically energizes the flow rate control valve plunger 11 into the direction of opening the valve body 12, and the solenoid 14 that drives the flow rate control valve plunger 11 into the direction of closing the valve body 12. The valve body 12 is connected to one end of the flow rate control valve plunger 11, and the compressed spring 13 is connected to the other end of the flow rate control valve plunger 11.

In this structure, the flow rate control valve plunger 11 opens or closes the low-pressure path 33 between the low-pressure fuel pump 31 and the pressurizing chamber 23 in accordance with the non-energization state or energization state of the solenoid 14.

As shown in FIG. 2A, when the solenoid 14 is not energized, the valve body 12 is pressed downward by the physical energization force of the compressed spring 13 and the low-pressure path 33 on the side of the low-pressure fuel pump 31 is continued to the pressurizing chamber 23. That is, the flow rate control valve 10 is open.

On the other hand, as shown in FIG. 2B, when the solenoid 14 is energized by the ECU 60, an electromagnetic force generated in the solenoid 14 overcomes the physical energization force of the compressed spring 13 and attracts the flow rate control valve plunger 11 upward.

As a result, the valve body 12, too, is drawn up, shutting off the continuation between the low-pressure path 33 on the side of the low-pressure fuel pump 31 and the pressurizing chamber 23. That is, the flow rate control valve 10 is closed.

Other than the flow rate control valve illustrated in FIGS. 2A and 2B (that is, the flow rate control valve in which the flow rate control valve plunger 11 and the valve body 12 are interlocked with each other), the flow rate control valve employed in the above-described Patent Reference 1 (that is, the flow rate control valve in which the flow rate control valve plunger 11 and the valve body 12 can freely move into contact with or away from each other and which has a valve closing spring acting to exert a physical energization force to close the valve body 12) can achieve the advantage of this invention.

Figure 3:
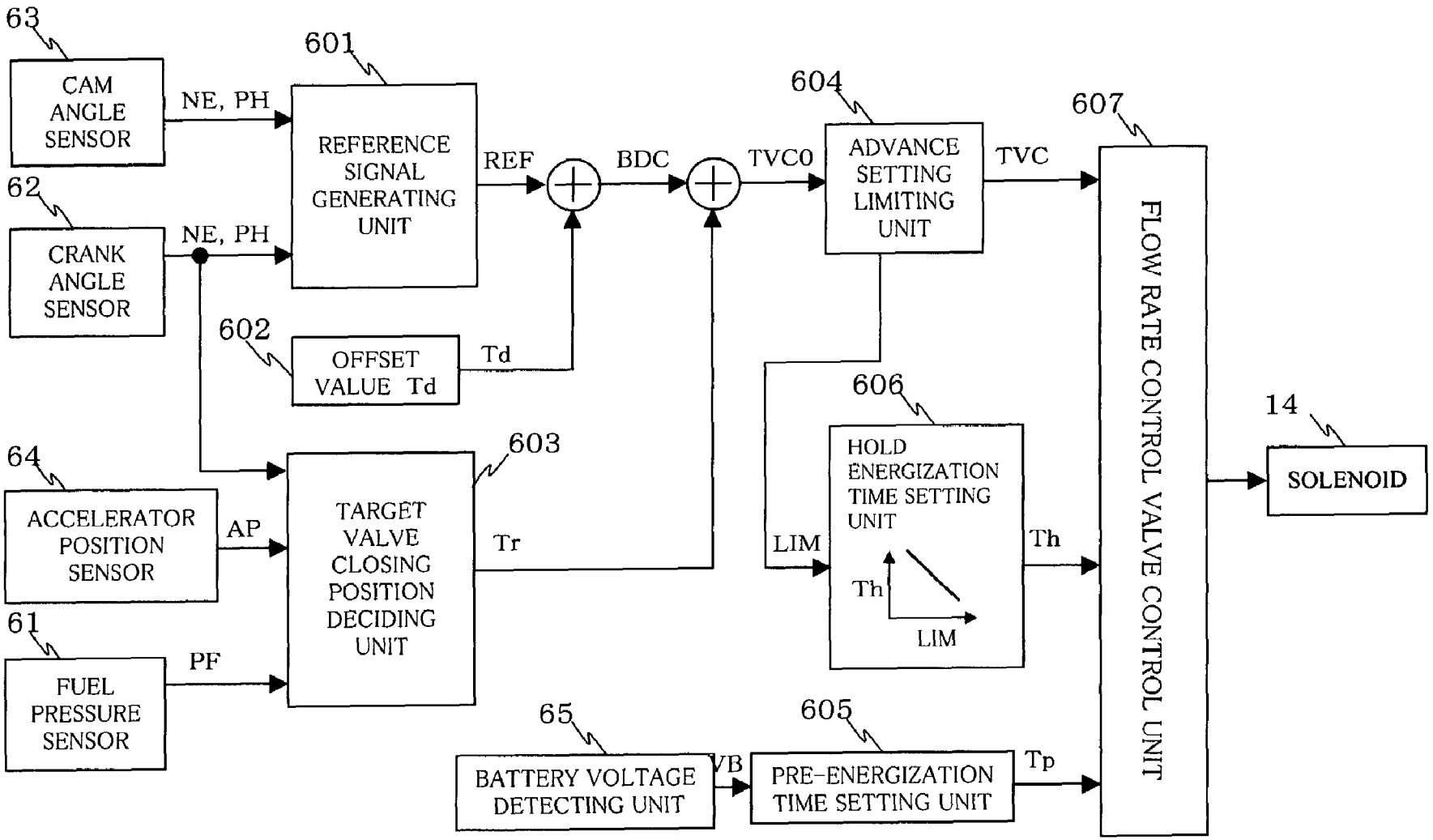
FIG. 3 is a functional block diagram showing an exemplary configuration of an electronic control unit (ECU) 60 shown in FIG. 1 according to Embodiment 1 of this invention.
Figure 4:
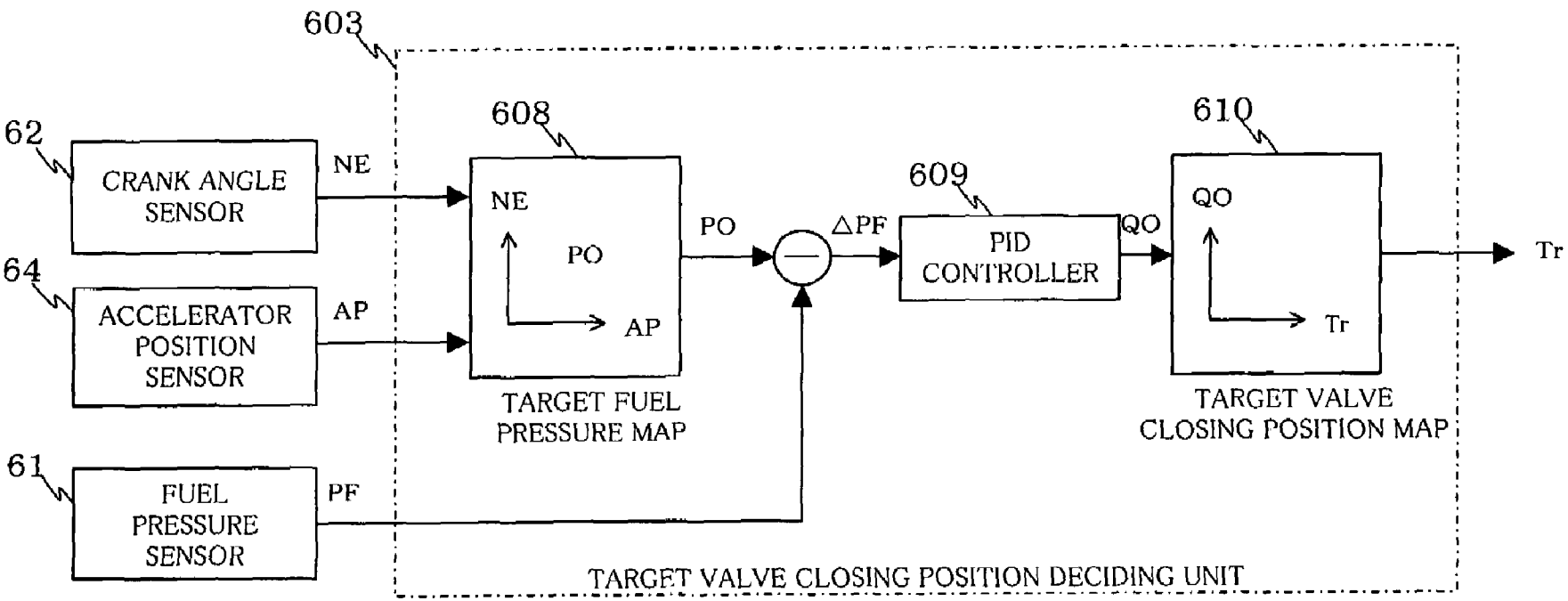
FIG. 4 is a block diagram showing the details of an exemplary function of a target valve closing position deciding unit 603 shown in FIG. 3 according to Embodiment 1 of this invention.

Referring to FIGS. 3 and 4, a specific structure of the ECU 60 shown in FIG. 1 will now be described.

Figure 2:
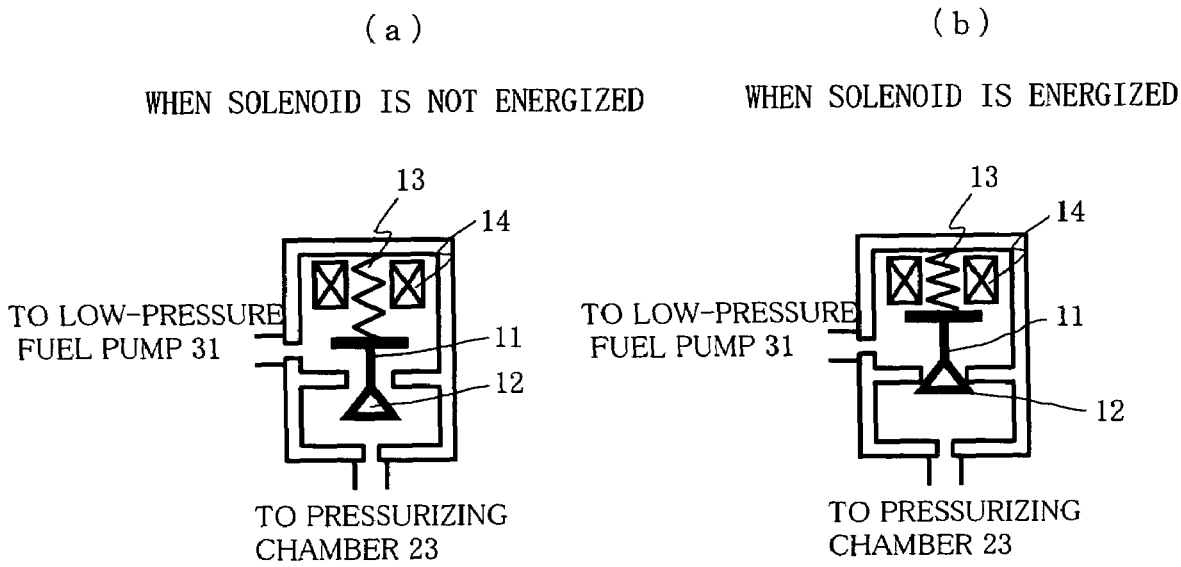
FIGS. 2A and 2B are longitudinal sectional views showing an example of an internal structure of a flow rate control valve 10 shown in FIG. 1 according to Embodiment 1 of this invention.

FIGS. 3 and 4 are functional block diagrams showing a specific exemplary structure of the ECU 60 according to Embodiment 1 of this invention. The parts similar to those shown in FIGS. 1 and 2 are denoted by the same numerals and will not be described further in detail.

In FIG. 3, the ECU 60 has a reference signal generating unit 601, an offset value 602, a target valve closing position deciding unit 603, an advance setting limiting unit 604, a pre-energization time setting unit 605, a hold energization time setting unit 606, and a flow rate control valve control unit 607.

The crank angle sensor 62 and the cam angle sensor 63 detect the number of rotations NE and the rotating position PH of the internal combustion engine. The accelerator position sensor 64 detects the quantity of depression AP of the accelerator pedal. The fuel pressure sensor 61 detects the fuel pressure PF in the fuel rail 36. The battery voltage detecting unit 65 detects the battery voltage VB. The solenoid 14 controls the driving of the flow rate control valve 10.

The reference signal generating unit 601 generates a reference signal REF based on the number of engine rotations NE and the rotating position PH found from output signals of the crank angle sensor 62 and the cam angle sensor 63. The offset value (=Td) 602 is added to the position of the reference signal REF to specify the timing of reaching an estimated bottom dead center BDC. The offset value Td is a value that defines the time difference between the timing of reaching the reference signal REF and the timing of reaching the estimated bottom dead center BDC. The offset value Td is stored in advance in a memory of the ECU, as a preset value.

To the target valve closing position deciding unit 603, the number of engine rotations NE found from the output signal of the crank angle sensor 62, the quantity of depression AP of the accelerator pedal detected by the accelerator position sensor 64, and the fuel pressure PF in the fuel rail 36 detected by the fuel pressure sensor 61 are inputted. The target valve closing position deciding unit 603 outputs the time difference (or position difference) Tr between the estimated bottom dead center BDC and the target valve closing position. The time difference Tr is added to the timing of reaching the estimated bottom dead center BDC to decide a basic target valve closing position TVC0 of the flow rate control valve 10.

FIG. 4 is a block diagram showing the details of the internal structure of the target valve closing position deciding unit 603.

In FIG. 4, two kinds of engine information, that is, the number of engine rotations NE and the quantity of depression AP of the accelerator pedal, are inputted to a target fuel pressure map 608 and a target fuel pressure PO is decided.

Next, the pressure difference ΔPF between the target fuel pressure PO and the actual fuel pressure PF in the fuel rail 36 is calculated. The pressure difference ΔPF is converted to a target quantity of ejection QO, for example, by a PID controller 609 that performs proportional, integral and differential operation, and the target quantity of ejection QO is inputted to a target valve closing position map 610.

Figure 14:
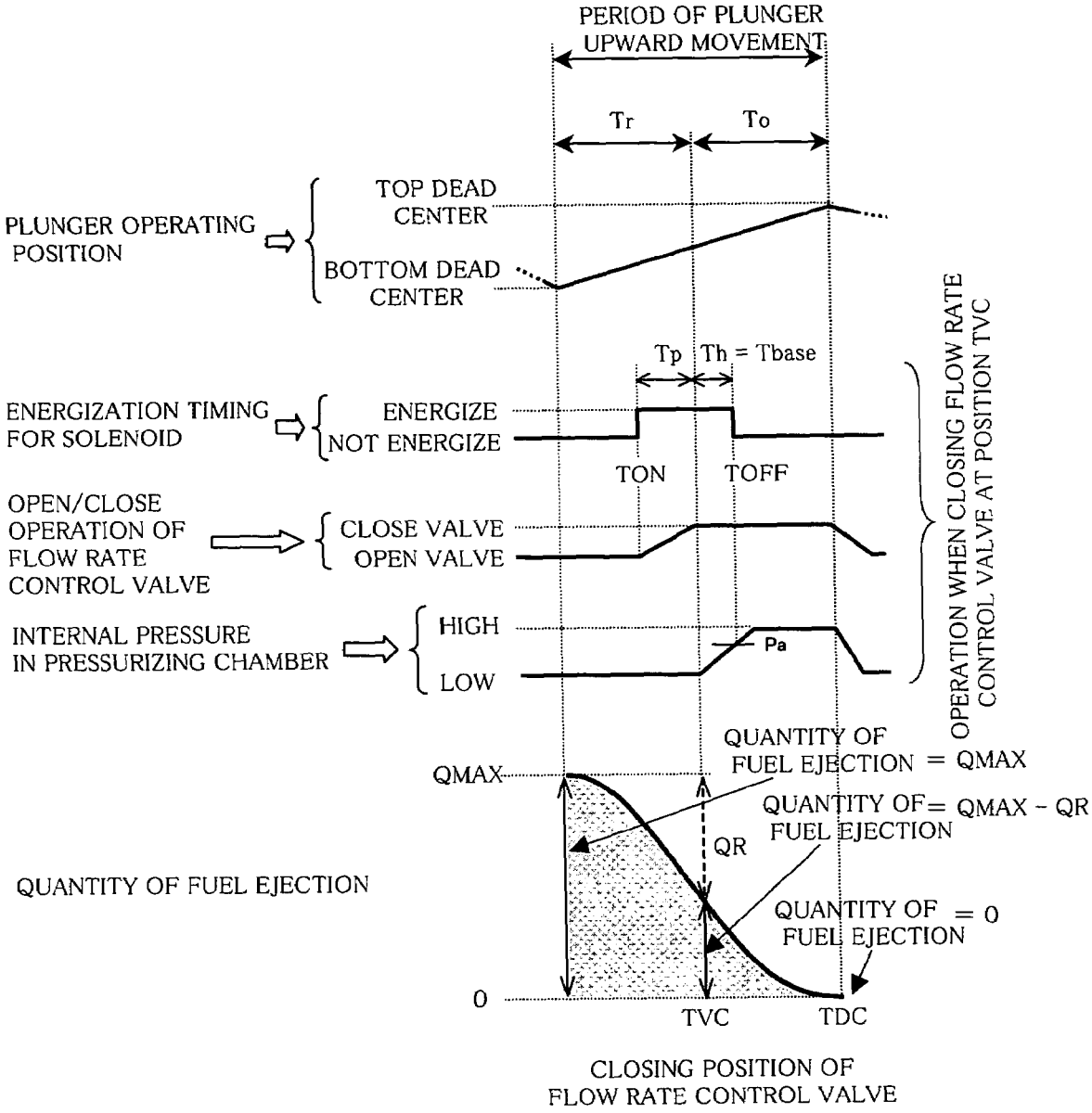
FIG. 14 is a graph showing the relation between the closing position of a flow rate control valve and the quantity of fuel ejection.

The target valve closing position map 610 includes map data for deciding the time (or angle) Tr to reach the target valve closing position TVC based on the plunger bottom dead center as a reference point, with respect to the target quantity of ejection QO. For example, the relation between the closing position of the flow rate control valve 10 and the quantity of fuel ejection as shown in FIG. 14 is stored as map data in the memory of the ECU in advance.

The advance setting limiting unit 604 shown in FIG. 3 is a unit that limits the setting of the target valve closing position TVC0 of the flow rate control valve 10 so that it does not exceed a predetermined advance limit value LIM toward the advance side. The advance setting limiting unit 604 limits the basic target valve closing position TVC0 so as not to exceed the advance limit value LIM toward the advance side, then decides a final target valve closing position TVC and inputs the final target valve closing position TVC to the flow rate control valve control unit 607.

The pre-energization time setting unit 605 sets a pre-energization time Tp in accordance with the battery voltage VB and inputs the pre-energization time Tp to the flow rate control valve control unit 607.

Figure 8:
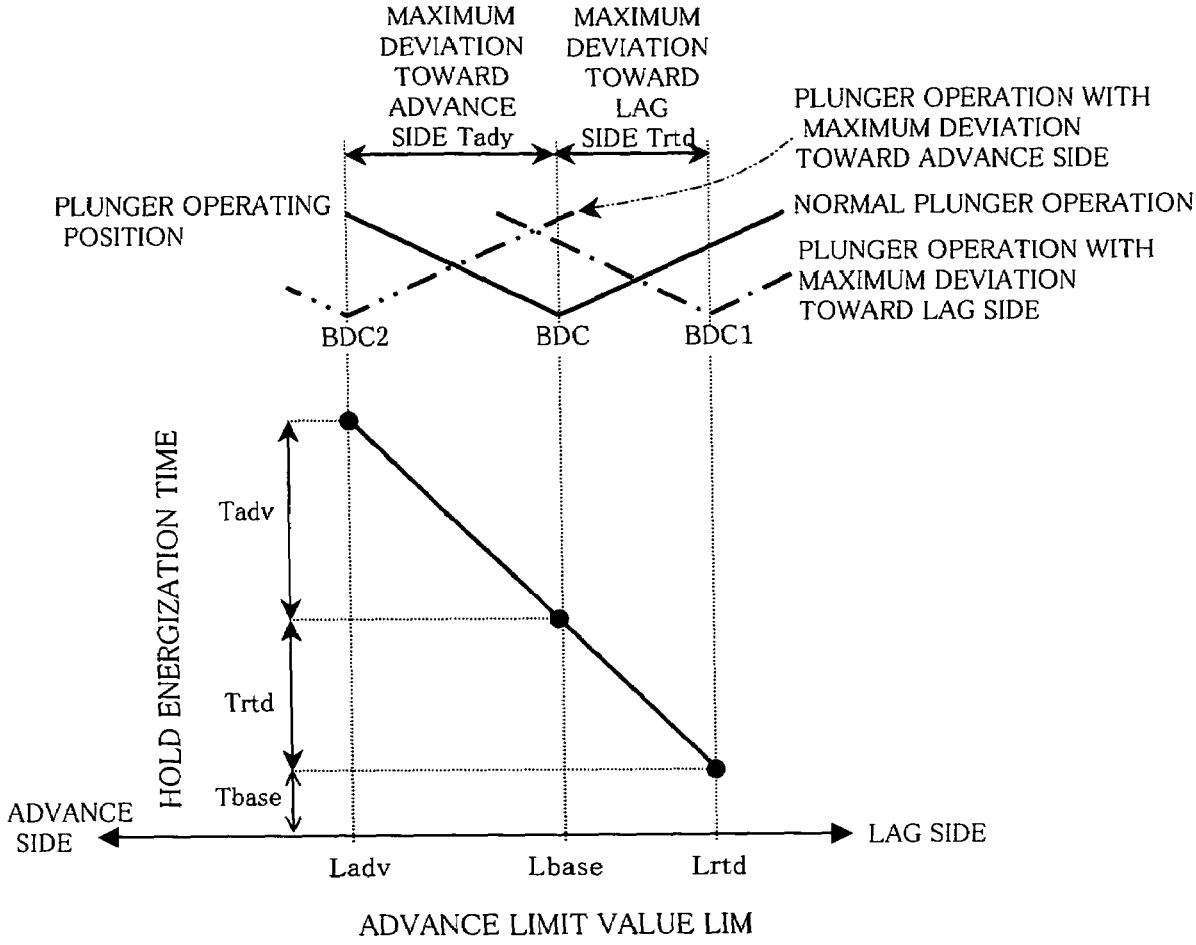
FIG. 8 illustrates an exemplary relation between advance limit value LIM and hole energization time Th according to this invention.

The hold energization time setting unit 606 selects an appropriate hold energization time Th in accordance with the advance limit value LIM set by the advance setting limiting unit, on the basis of FIG. 8, and inputs the hold energization time Th to the flow rate control valve control unit 607. As for the hold energization time Th, it is also possible to store time data or angle data for each number of engine rotations NE in advance in the memory of the ECU, and decide the hold energization time Th in accordance with the number of engine rotations NE when performing actual control.

To the flow rate control valve control unit 607, the target valve closing position TVC decided by the advance setting limiting unit 604, the pre-energization time Tp set by the pre-energization time setting unit 605, and the hold energization time Th set by the hold energization time setting unit 605 are inputted. The flow rate control valve control unit 607 performs control to start the energization of the solenoid 14 at a time point TON preceding the time point of the target valve closing position TVC by the pre-energization time Tp and to end the energization of the solenoid 14 at a time point TOFF that is after the lapse of the hold energization time Th from the time point of the target valve closing position TVC.

Now, the control operation in Embodiment 1 of this invention will be described with reference to the flowchart of FIG. 5.

Figure 5:
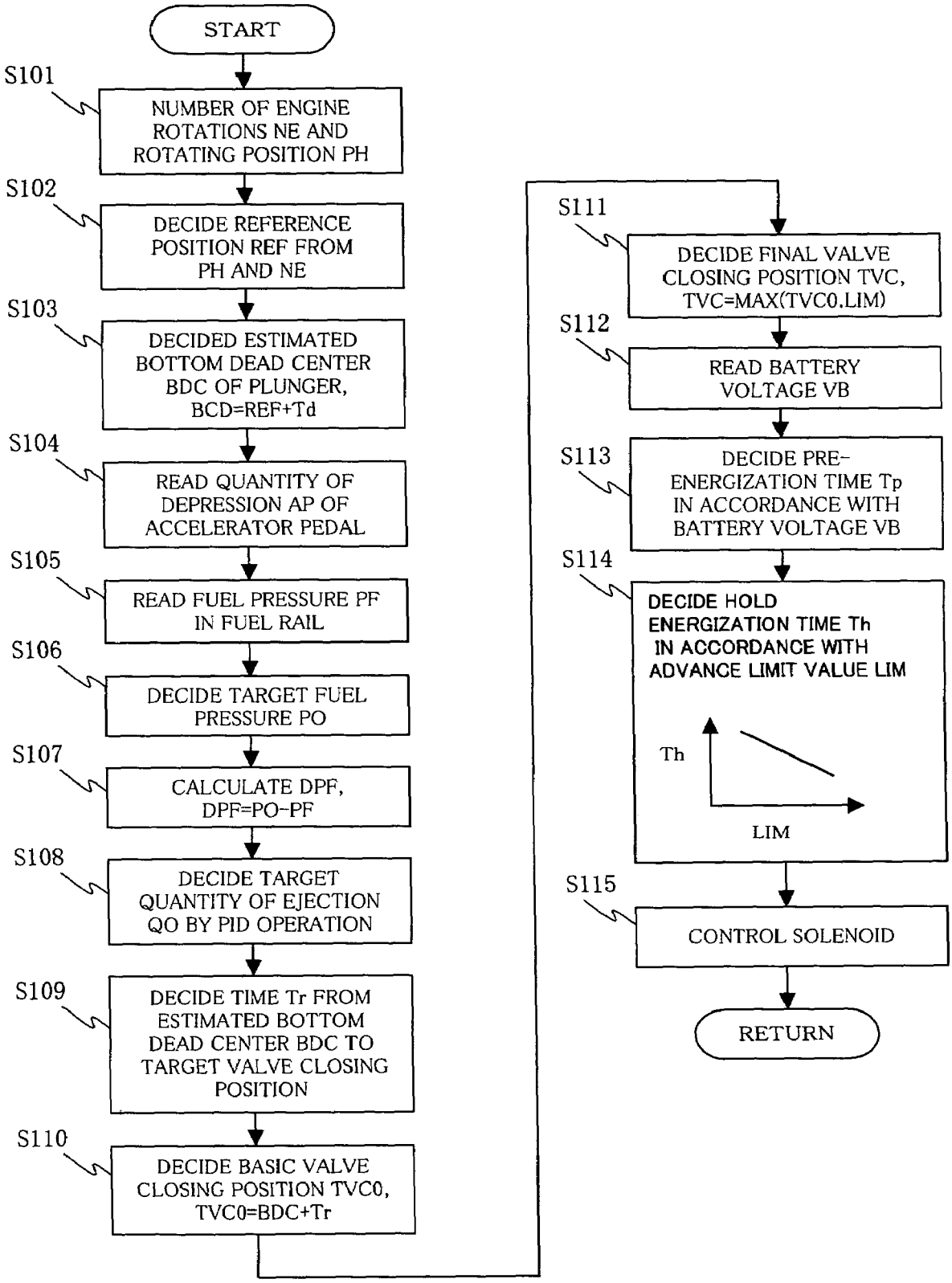
FIG. 5 is a flowchart showing an exemplary control operation according to Embodiment 1 of this invention.

In FIG. 5, first, at step S101, the number of engine rotations NE and the rotating position PH are read. At step S102, the reference position REF is decided on the basis of the number of engine rotations NE and the rotating position PH read at step S101. At step S103, the offset value Td is added to the reference position REF decided at step S102, thus specifying the estimated bottom dead center BDC (=REF+Td).

Next, at step S104, the quantity of depression AP of the accelerator pedal is read. At step S105, the actual fuel pressure PF in the fuel rail 36 is read. Then, the processing shifts to step S106.

At step S106, the number of engine rotations NE read at step S101 and the quantity of depression AP of the accelerator pedal read at step S104 are inputted to the target fuel pressure map 608 in the target valve closing position setting unit 603, and the target fuel pressure PO is decided. The processing then shifts to step S107.

At step S107, the pressure difference ΔPF=PO−PF between the target fuel pressure PO decided at step S106 and the actual fuel pressure PF in the fuel rail 36 read at step S105 is calculated. At the next step S108, PID operation is performed on the basis of the pressure difference ΔPF calculated at step S107, thus deciding the target quantity of ejection QO. The processing then shifts to step S109.

At step S109, the target quantity of ejection QO decided at step S108 is inputted to the target valve closing position map 610 in the target valve closing position setting unit 603, and the time (or angle) Tr from the time point of the bottom dead center to the time point of the valve closing position is decided. The processing then shifts to step S110.

At step S110, the estimated bottom dead center BDC decided at step S103 is added to Tr decided at step S109, thus deciding the basic valve closing position TVC0=BDC+Tr. The processing then shifts to step S111.

At step S111, the basic valve closing position TVC0 decided at step S110 is limited so as not to exceed the advance limit value LIM toward the advance side, thus deciding the final target valve closing position TVC=MAX (TVC0, LIM). The processing then shifts to step S112.

At step S112, the battery voltage VB is read. At the next step S113, the pre-energization time Tp in accordance with the battery voltage VB read at step S112 is decided. The processing then shifts to step S114.

At step S114, the hold energization time Th in accordance with the advance limit value LIM is employed. The processing then shifts to step S115. Here, for example, if the advance limit value is LIM=Ladv, the hold energization time is decided to be Th=Tbase+Trtd+Tadv.

At step S115, on the basis of the final target valve closing position TVC decided at step S111, the pre-energization time Tp decided at step 113, and the hold energization time Th decided at step S114, the solenoid 14 is controlled so that the energization of the solenoid 14 is started at a time point preceding the time point of the final target valve closing position TVC by the pre-energization time Tp, and so that the energization of the solenoid 14 is ended at a time point that is after the lapse of the hold energization time Th from the time point of the final target valve closing position TVC. The processing then ends.

Embodiment 2

Hereinafter, an energy-saving high-pressure fuel supply control device for internal combustion engine according to Embodiment 2 of this invention will be described with reference to the flowchart of FIG. 6. Embodiment 2 of this invention differs only in step S114 shown the flowchart of FIG. 5, that is, the function of setting the hold energization time Th. Therefore, only the operation to replace step S114 of FIG. 5 will be described here with reference to the flowchart of FIG. 6.

Figure 6:
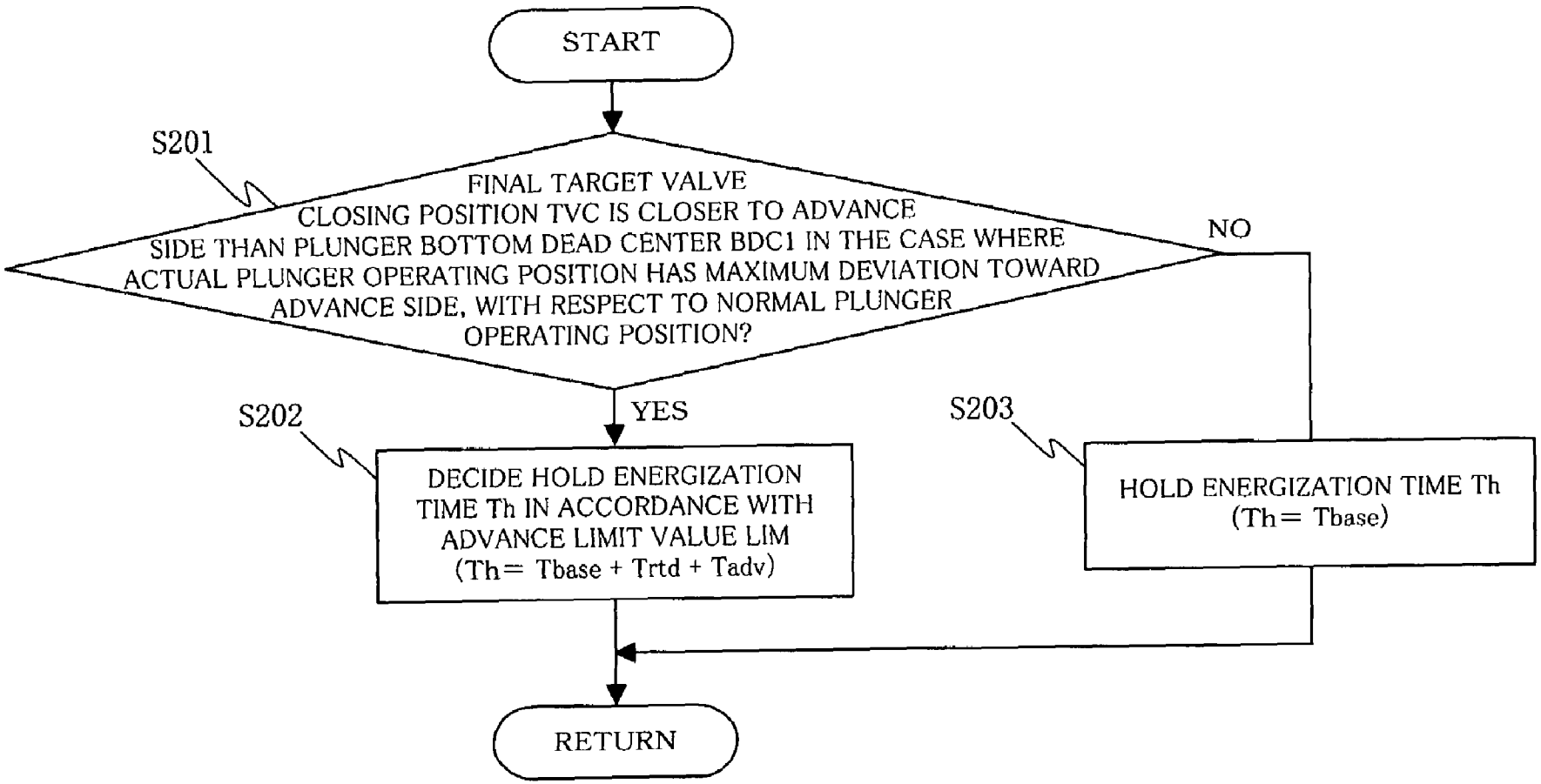
FIG. 6 is a flowchart showing an exemplary control operation according to Embodiment 2 of this invention.

In Embodiment 2 of this invention, after the processing goes through steps S101 to S113 of FIG. 5, the processing shifts to step S201 of FIG. 6.

At step S201, it is judged whether or not the final target valve closing position TVC decided at step S111 of FIG. 5 is decided to be closer to the advance side than the plunger bottom dead center BDC1 in the case where the actual plunger operating position has a maximum deviation toward the lag side.

If the result of the judgment at step S201 is YES, the processing goes from step S201 to step S202 and the hold energization time Th in accordance with the advance limit value LIM is employed. Then, the processing of FIG. 6 ends (i.e., shifts to step S115 of FIG. 5). Here, for example, if the advance limit value is LIM=Ladv, the hold energization time Th=Tbase+Trtd+Tadv is employed and the processing of FIG. 6 ends (i.e., shifts to step S115 of FIG. 5).

On the other hand, if the result of the judgment at step S201 is NO, the processing goes from step S201 to step S203 and the hold energization time Th=Tbase is employed. Then, the processing of FIG. 6 ends (i.e., shifts to step S115 of FIG. 5).

Embodiment 3

Hereinafter, an energy-saving high-pressure fuel supply control device for internal combustion engine according to Embodiment 3 of this invention will be described with reference to the flowchart of FIG. 7. Embodiment 3 of this invention differs only in steps S111 and S114 shown in the flowchart of FIG. 5, that is, the function of deciding the final valve closing position TVC and the function of setting the hold energization time Th. Therefore, only the operation to replace steps S111 to S114 of FIG. 5 will be described here with reference to the flowchart of FIG. 7.

Figure 7:
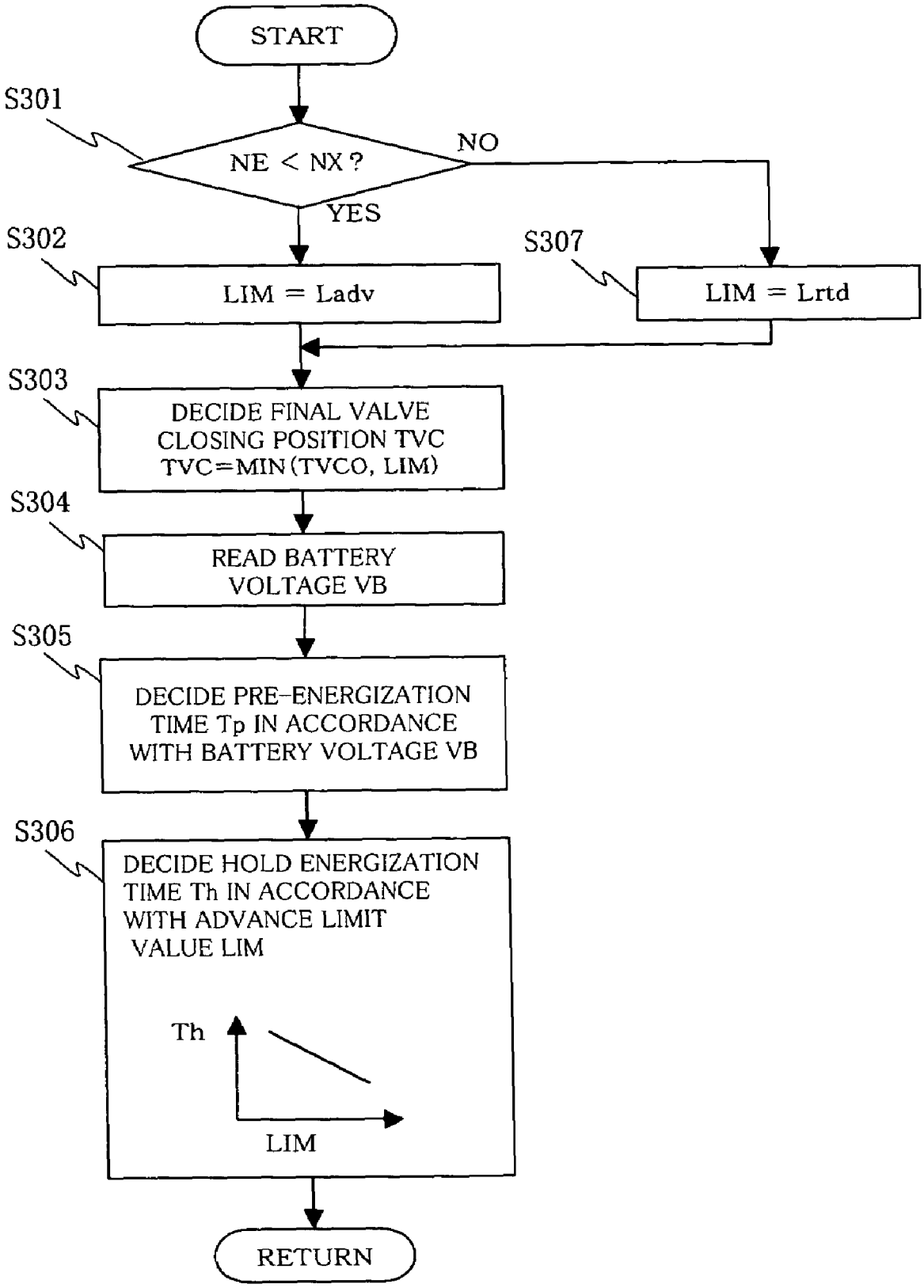
FIG. 7 is a flowchart showing an exemplary control operation according to Embodiment 3 of this invention.

In Embodiment 3 of this invention, after the processing goes through steps S101 to S110 of FIG. 5, the processing shifts to step S301 of FIG. 7.

At step S301, it is judged whether the number of engine rotations NE read at step S101 of FIG. 5 is less than a predetermined number of rotations NX or not. The predetermined number of rotations NX is an upper limit number of rotations at which the above-described heat development is not probable even when the hold energization time Th is set to be long, as described above with reference to FIG. 9.

If the result of the judgment at step S301 is YES (i.e., NE<NX), the processing shifts from step S301 to step S302 and, for example, the position Ladv closer to the advance side than the estimated bottom dead center BDC is selected as the advance limit value LIM. The processing then shifts to step S303. At step S303, the basic valve closing position TVC0 decided at step S110 of FIG. 5 is limited so as not to exceed the advance limit value LIM=Ladv decided at step S302, toward the advance side. The final target valve closing position TVC=MAX(TVC0, LIM) is thus decided and the processing shifts to step S304.

On the other hand, if the result of the judgment at step S301 is NO (i.e., NE≧NX), the processing shifts from step S301 to step S307 and, for example, the same position Lrtd as the bottom dead center BDC1 in the case where the plunger has the maximum deviation Trtd toward the lag side is selected as the advance limit value LIM. The processing then shifts to step S303. At step S303, the basic valve closing position TVC0 decided at step S110 of FIG. 5 is limited so as not to exceed the advance limit value LIM=Lrtd decided at step S302, toward the advance side. The final target valve closing position TVC=MAX(TVC0, LIM) is thus decided and the processing shifts to step S304.

Next, at steps S304 and S305, the pre-energization time Tp in accordance with the battery voltage VB is set, as in the processing at steps S112 and S113 of FIG. 5. Then, the processing shifts to step S306.

At step S306, if the advance limit value LIM=Ladv decided at step S302 is employed, the hold energization time Th=Tbase+Trtd+Tadv is set, and the processing of FIG. 7 ends (i.e., shifts to step S115 of FIG. 5).

On the other hand, if the advance limit value LIM=Lrtd decided at step S307 is selected, the hold energization time Th=Tbase is set, and the processing of FIG. 7 ends (i.e., shifts to step S115 of FIG. 5).

As described above, the energy-saving high-pressure fuel supply control device for internal combustion engine according to the first aspect of this invention includes: the high-pressure fuel pump 20 that has the plunger 22 driven to reciprocate by the pump cam 25 interlocked with the internal combustion engine, sucks low-pressure fuel via the flow rate control valve 10 during the movement of the plunger 22 from the top dead center TDC toward the bottom dead center BDC, pressurizes the sucked fuel during the movement of the plunger 22 from the bottom dead center BDC toward the top dead center TDC, and supplies the high-pressure fuel provided by the pressurization, to the fuel rail 36; and the electronic control unit 60 that performs energization control to the flow rate control valve 10. At a time point that is logically determined from the time point of the bottom dead center BDC and when the pressure of the high-pressure fuel rises to the pressure Pa to hold closing of the flow rate control valve 10, the electronic control unit 60 ends the energization of the flow rate control valve 10 to restrain energization energy to the flow rate control valve. The time point TOFF when the energization of the flow rate control valve 10 is ended is deviated toward the lag side in advance by a time that causes deviation of the bottom dead center BDC of the plunger 22 toward the lag side from the original bottom dead center BDC.

The energy-saving high-pressure fuel supply control device for internal combustion engine according to the second aspect of this invention includes: the high-pressure fuel pump 20 that has the plunger 22 driven to reciprocate by the pump cam 25 interlocked with the internal combustion engine, sucks low-pressure fuel via the flow rate control valve 10 during the movement of the plunger 22 from the top dead center TDC toward the bottom dead center BDC, pressurizes the sucked fuel during the movement of the plunger 22 from the bottom dead center BDC toward the top dead center TDC, and supplies the high-pressure fuel provided by the pressurization, to the fuel rail 36; and the electronic control unit 60 that performs energization control to the flow rate control valve 10. At a time point that is logically determined from the time point of the bottom dead center BDC and when the pressure of the high-pressure fuel rises to the pressure Pa to hold closing of the flow rate control valve 10, the electronic control unit 60 ends the energization of the flow rate control valve 10 to restrain energization energy to the flow rate control valve 10. The time point TON when the energization of the flow rate control valve 10 is started is deviated toward the advance side in advance by a time that causes deviation of the bottom dead center BDC of the plunger 22 toward the advance side from the original bottom dead center BDC.

The energy-saving high-pressure fuel supply control device for internal combustion engine according to the third aspect of this invention includes: the high-pressure fuel pump 20 that repeats suction and ejection of fuel in accordance with operation of the plunger 22 that reciprocates in the pressurizing chamber 23; the ejection valve 35 that is arranged in the ejection path 34 connecting the pressurizing chamber 23 to the fuel rail 36 and that only allows circulation of fuel directed toward the fuel rail 36 from the pressurizing chamber 23; the low-pressure fuel pump 31 that supplies fuel in the fuel tank 30 to the pressurizing chamber 23; the flow rate control valve 10 that is arranged in the low-pressure path 33 connecting one of the fuel tank 30 and the low-pressure fuel pump 31 to the pressurizing chamber 23 and that is driven by energization of the solenoid 14; the target valve closing position deciding unit 603 that decides the target valve closing position TVC of the flow rate control valve 10; the advance setting limiting unit 604 that limits the decision of the target valve closing position TVC so as not to exceed the predetermined advance limit value LIM=Lbase toward the advance side; the pre-energization time setting unit 605 that sets the pre-energization time Tp equivalent to an operation lag time from the time TON when the energization of the solenoid 14 is started until the flow rate control valve 10 is closed; the hold energization time setting unit 606 that sets the hold energization time Th equivalent to a time period to continue the energization of the solenoid 14 after the flow rate control valve 10 is closed; and the flow rate control vale control unit 607 that starts the energization of the solenoid 14 at a time point preceding the time point of the target valve closing position TVC by the pre-energization time Tp and ends the energization of the solenoid 14 at a time point TOFF that is after the lapse of the hold energization time Th from the time point of the target valve closing position TVC. The advance limit value LIM is set at a position closer to the advance side than the plunger bottom dead center BDC reaching position on the assumption that the plunger 22 is operating with a maximum deviation toward the lag side from the normal timing. In the case where a time from when the flow rate control valve 10 is closed until the internal pressure in the pressurizing chamber 23 rises to or higher than the pressure Pa at which it acts as a physical energization force to close the flow rate control valve 10 is defined as the basic energization time Tbase, and where the time difference Trtd between the reaching timing of the plunger bottom dead center BDC and the reaching timing of the advance limit value on the assumption that the plunger 22 is operating with the maximum deviation toward the lag side from the normal timing is defined as the position deviation compensation time Trtd, the hold energization time is set to be a time at least equal to or longer than the sum of the basic energization time Tbase and the position deviation compensation time Trtd.

As described above, the relation between the advance limit value LIM and the hold energization time Th in the energy-saving high-pressure fuel supply control device for internal combustion engine according to the third aspect of the invention is graphically shown in FIG. 8. FIG. 8 shows plunger operating positions and the hold energization time Th to be set in accordance with the advance limit value LIM in three cases, that is, where the plunger 22 is operating at the normal operating position (solid line), where the plunger operation is deviated by the maximum amount of Trtd toward the lag side (single-dotted chain line), and where the plunger operation is deviated by the maximum amount of Tadv toward the advance side (double-dotted chain line). According to the third aspect of the invention, the advance limit value LIM is set toward the advance side from Lrtd equivalent to the reaching position of the plunger bottom dead center BDC1 in the case where the plunger operation is deviated by the maximum toward the lag side, and the hold energization time Th is set to be the time equal to the sum of the basic energization time Tbase and the position deviation compensation time (i.e., time equivalent to the positional difference between the BDC1 reaching position and the setting position of the advance limit value LIM). As illustratively shown in FIG. 8, the hold energization time Th in the case where the advance limit value LIM is set at the position of Lbase is set to be Th=Tbase+Trtd as the minimum necessary time, and the hold energization time Th in the case where the advance limit value LIM is set at the position of Ladv is set to be Th=Tbase+Trtd+Tadv as the minimum necessary time.

As described above, in the energy-saving high-pressure fuel supply control device for internal combustion engine according to the fourth aspect of this invention, the advance limit value is set at a position closer to the advance side than the plunger bottom dead center BDC reaching position in the case the plunger 22 is operating at the normal timing.

That is, while the advance limit value LIM in the conventional technique is set to be LIM=Lbase (that is, the same position as the bottom dead center BDC in the case where the plunger is operating at the normal timing), the advance limit value according to the fourth aspect of the invention is set to be LIM>Lbase (that is, closer to the advance side than the plunger bottom dead center reaching position in the case where the plunger is operating at the normal timing).

As described above, in the energy-saving high-pressure fuel supply control device for internal combustion engine according to the fifth aspect of this invention, the advance limit value is set at the same position as the plunger bottom dead center BDC reaching position on the assumption that the plunger 22 is operating with the maximum deviation toward the advance side from the normal timing. That is, in the energy-saving high-pressure fuel supply control device for internal combustion engine according to the fifth aspect of this invention, the advance limit value is set specifically to the position of LIM=Ladv.

As described above, in the energy-saving high-pressure fuel supply control device for internal combustion engine according to the sixth aspect of this invention, when the target valve closing position TVC is decided to be closer to the lag side than the reaching position of the plunger bottom dead center BDC on the assumption that the plunger 22 is operating with the maximum deviation toward the lag side from the normal timing, the hold energization time is switched to a time that is shorter than the time equivalent to the sum of the basic energization time Tbase and the position deviation compensation time Trtd. More preferably, as in the energy-saving high-pressure fuel supply control device for internal combustion engine according to the seventh aspect of this invention, when the target valve closing position TVC is decided to be closer to the lag side than the reaching position of the plunger bottom dead center BDC on assumption that the plunger 22 is operating with the maximum deviation toward the lag side from the normal timing, the hold energization time Th is switched to a time that secures at least the basic energization time Tbase.

As described above, in the energy-saving high-pressure fuel supply control device for internal combustion engine according to the eighth aspect of this invention, the advance limit value LIM is set at different values in accordance with the number of engine rotations NE. More preferably, as in the energy-saving high-pressure fuel supply control device for internal combustion engine according to the ninth aspect of this invention, the advance limit value LIM is set at a value closer to the lag side when the number of engine rotations NE is larger than when it is smaller.

Figure 9:
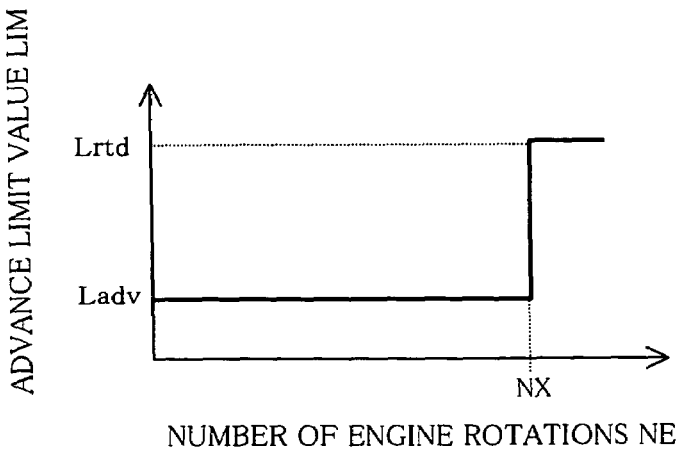
FIG. 9 illustrates a control condition with respect to the number of engine rotations according to Embodiment 3 of this invention.

If the hold energization time Th is set to be longer than the basic energization time Tbase, as in the energy-saving high-pressure fuel supply control device for internal combustion engine according to the third to fifth aspects of the invention, the larger the number of engine rotations NE is, the shorter the energization cycle of the solenoid 14 of the flow rate control valve 10 becomes and the calorific value of the solenoid 14 increases. In the worst case, malfunction of the flow rate control valve 10 may occur because of fusion of the solenoid 14 or fusion damage of the mold material. Thus, in the case where such malfunction is anticipated, when the engine is in the low-rotation zone (NE<NX) where heat development is not probable, as shown in FIG. 9, for example, the advance limit value is set to LIM=Ladv and the hold energization time Th=Tbase+Trtd+Tadv is employed. Meanwhile, only when the engine is in the high-rotation zone (NE≧NX) where heat development is probable, for example, the advance limit value is switched to LIM=Lrtd and the hold energization time is switched to Th=Tbase.

As a result, only when the engine is in the high-rotation zone where the calorific value of the solenoid 14 is not allowed, the hold energization time Th is changed to a shorter time and the heat development in the solenoid 14 is restrained.

In FIG. 9, the advance limit value LIM is switched in two stages on the basis of the judged number of rotations NX. However, it is also possible to confirm an advance limit value LIM defining a heat development limit for each number of rotations in advance and precisely set the advance limit value for each number of rotations.

As described above, in the embodiment according to this invention, the energy-saving high-pressure fuel supply control device for internal combustion engine includes: the high-pressure fuel pump 20 that has the plunger 22 driven to reciprocate by the pump cam 25 interlocked with the internal combustion engine, sucks low-pressure fuel via the flow rate control valve 10 during the movement of the plunger 22 from the top dead center TDC toward the bottom dead center BDC, pressurizes the sucked fuel during the movement of the plunger 22 from the bottom dead center BDC toward the top dead center TDC, and supplies the high-pressure fuel provided by the pressurization, to the fuel rail 36; and the electronic control unit 60 that performs energization control to the flow rate control valve 10. At a time point that is logically determined from the time point of the bottom dead center BDC and when the pressure of the high-pressure fuel rises to the pressure Pa to hold closing of the flow rate control valve 10, the electronic control unit 60 ends the energization of the flow rate control valve 10 to restrain energization energy to the flow rate control valve. The time point TOFF when the energization of the flow rate control valve 10 is ended is deviated toward the lag side in advance by a time that causes deviation of the bottom dead center BDC of the plunger 22 toward the lag side from the original bottom dead center BDC. Therefore, when performing ejection control of the maximum quantity of fuel from the high-pressure fuel pump 20 in the state where the operating position of the plunger 22 is deviated, it is possible to overcome the problem of uncontrollable ejection quantity causing deviation of fuel pressure from the target fuel pressure and hence deterioration in drivability and exhaust gas.

Also, as described above, in the embodiment according to this invention, the energy-saving high-pressure fuel supply control device for internal combustion engine includes: the high-pressure fuel pump 20 that has the plunger 22 driven to reciprocate by the pump cam 25 interlocked with the internal combustion engine, sucks low-pressure fuel via the flow rate control valve 10 during the movement of the plunger 22 from the top dead center TDC toward the bottom dead center BDC, pressurizes the sucked fuel during the movement of the plunger 22 from the bottom dead center BDC toward the top dead center TDC, and supplies the high-pressure fuel provided by the pressurization, to the fuel rail 36; and the electronic control unit 60 that performs energization control to the flow rate control valve 10. At a time point that is logically determined from the time point of the bottom dead center BDC and when the pressure of the high-pressure fuel rises to the pressure Pa to hold closing of the flow rate control valve 10, the electronic control unit 60 ends the energization of the flow rate control valve 10 to restrain energization energy to the flow rate control valve. The time point TON when the energization of the flow rate control valve 10 is started is deviated toward the advance side in advance by a time that causes deviation of the bottom dead center BDC of the plunger 22 toward the advance side from the original bottom dead center BDC. Therefore, when performing ejection control of the maximum quantity of fuel from the high-pressure fuel pump 20 in the state where the operating position of the plunger 22 is deviated, it is possible to overcome the problem of uncontrollable ejection quantity causing deviation of fuel pressure from the target fuel pressure and hence deterioration in drivability and exhaust gas.

Moreover, as described above, in the embodiment according to this invention, the energy-saving high-pressure fuel supply control device for internal combustion engine includes: the high-pressure fuel pump 20 that alternately repeats suction of low-pressure fuel and ejection of high-pressure fuel to the fuel rail 36 in accordance with operation of the plunger 22 that reciprocates in the pressurizing chamber 23; the flow rate control valve 10 that is arranged in the low-pressure path 33 connecting the low-pressure fuel side to the pressurizing chamber 23 and that is driven by energization of the solenoid 14; the target valve closing position deciding unit 603 that decides the target valve closing position TVC of the flow rate control valve 10; the advance setting limiting unit 604 that limits the decision of the target valve closing position TVC so as not to exceed the predetermined advance limit value LIM toward the advance side; the pre-energization time setting unit 605 that sets the pre-energization time Tp equivalent to an operation lag time from when the energization of the solenoid 14 is started until the flow rate control valve 10 is closed; the hold energization time setting unit 606 that sets the hold energization time Th equivalent to a time period to continue the energization of the solenoid 14 after the flow rate control valve 10 is closed; and the flow rate control vale control unit 607 that starts the energization of the solenoid 14 at a time point preceding the time point of the target valve closing position TVC by the pre-energization time Tp and ends the energization of the solenoid 14 at a time point that is after the lapse of the hold energization time Th from the time point of the target valve closing position TVC. The advance limit value LIM is set at a position closer to the advance side than the plunger bottom dead center BDC reaching position on the assumption that the plunger 22 is operating with the maximum deviation toward the lag side from the normal timing. In the case where the time from when the flow rate control valve 10 is closed until the internal pressure in the pressurizing chamber 23 rises to or higher than the pressure Pa at which it acts as a physical energization force to close the flow rate control valve 10 is defined as the basic energization time Tbase, and where the time difference Trtd between the reaching timing of the plunger bottom dead center BDC and the reaching timing of the advance limit value LIM on the assumption that the plunger 22 is operating with the maximum deviation toward the lag side from the normal timing is defined as the position deviation compensation time Trtd, the hold energization time Th is set to be a time at least equal to or longer than the sum of the basic energization time Tbase and the position deviation compensation time Trtd. Therefore, when performing ejection control of the maximum quantity of fuel from the high-pressure fuel pump 20 in the state where the operating position of the plunger 22 is deviated, it is possible to overcome the problem of uncontrollable ejection quantity causing deviation of fuel pressure from the target fuel pressure and hence deterioration in drivability and exhaust gas.

As described above, FIGS. 10 and 11 show control operations in the case where the plunger is operating at normal timing (sold line) and in the case where the plunger is operating with a maximum deviation Trtd toward the lag side (single-dotted line).

Figure 10:
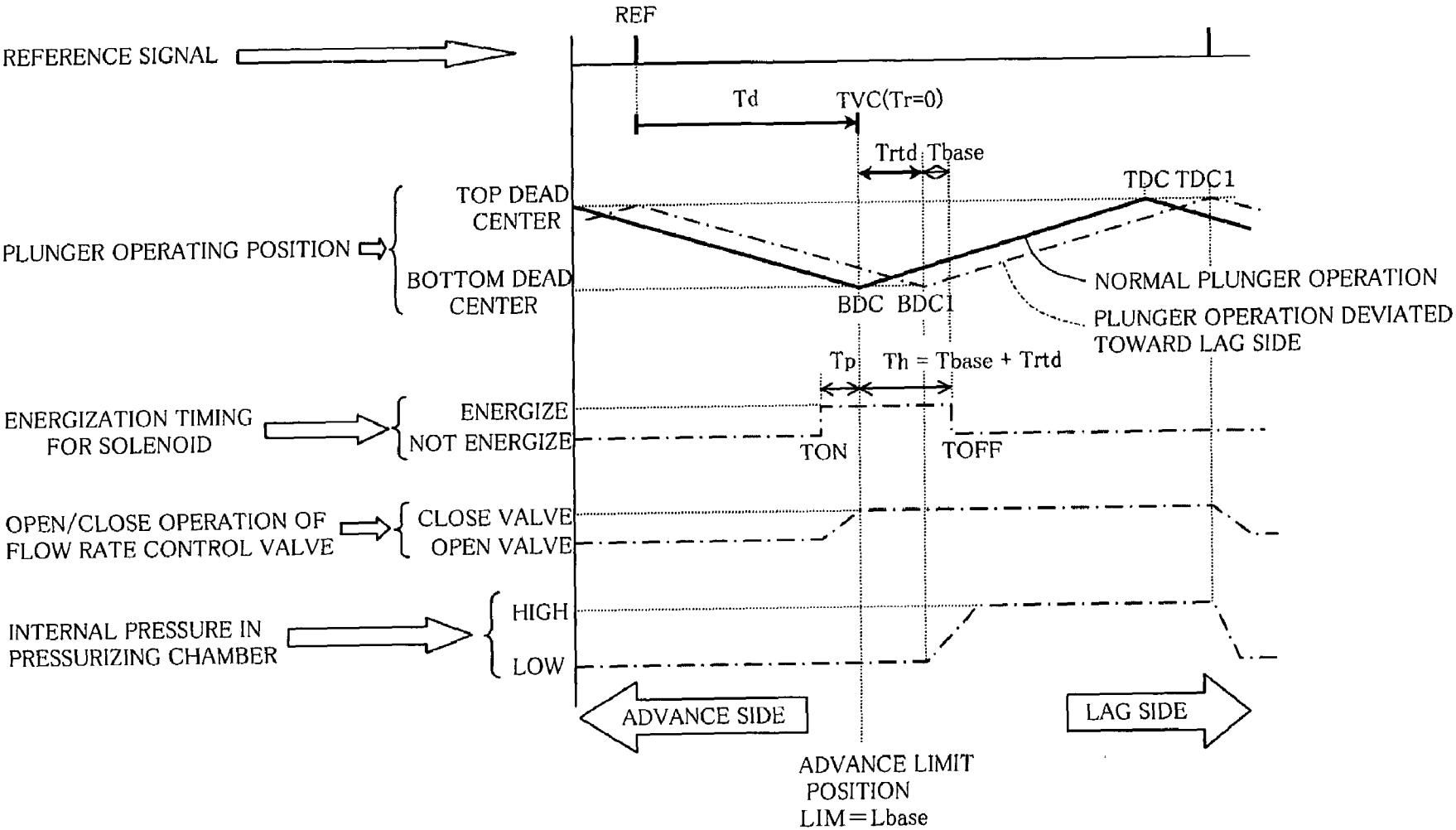
FIG. 10 is a first time chart illustrating an advantage of the invention according to Embodiment of 1 of the invention.
Figure 11:
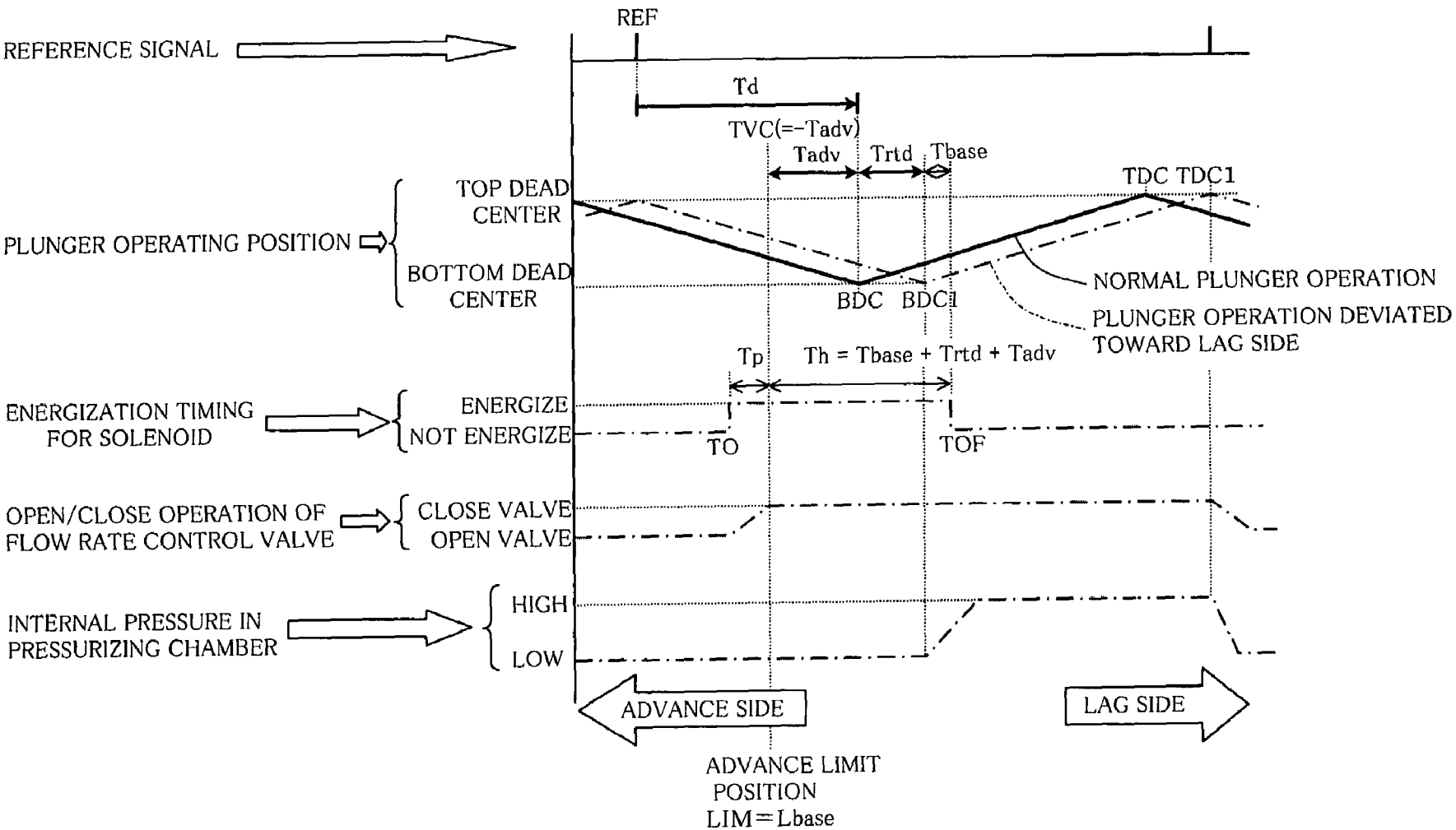
FIG. 11 is a second time chart illustrating an advantage of the invention according to Embodiment 1 of the invention, which is different from the first time chart.

Both of FIGS. 10 and 11 are similar to the conventional technique in that the time point after the lapse of the offset value Td from the reference signal REF is specified as the estimated bottom dead center BDC.

Figure 15:
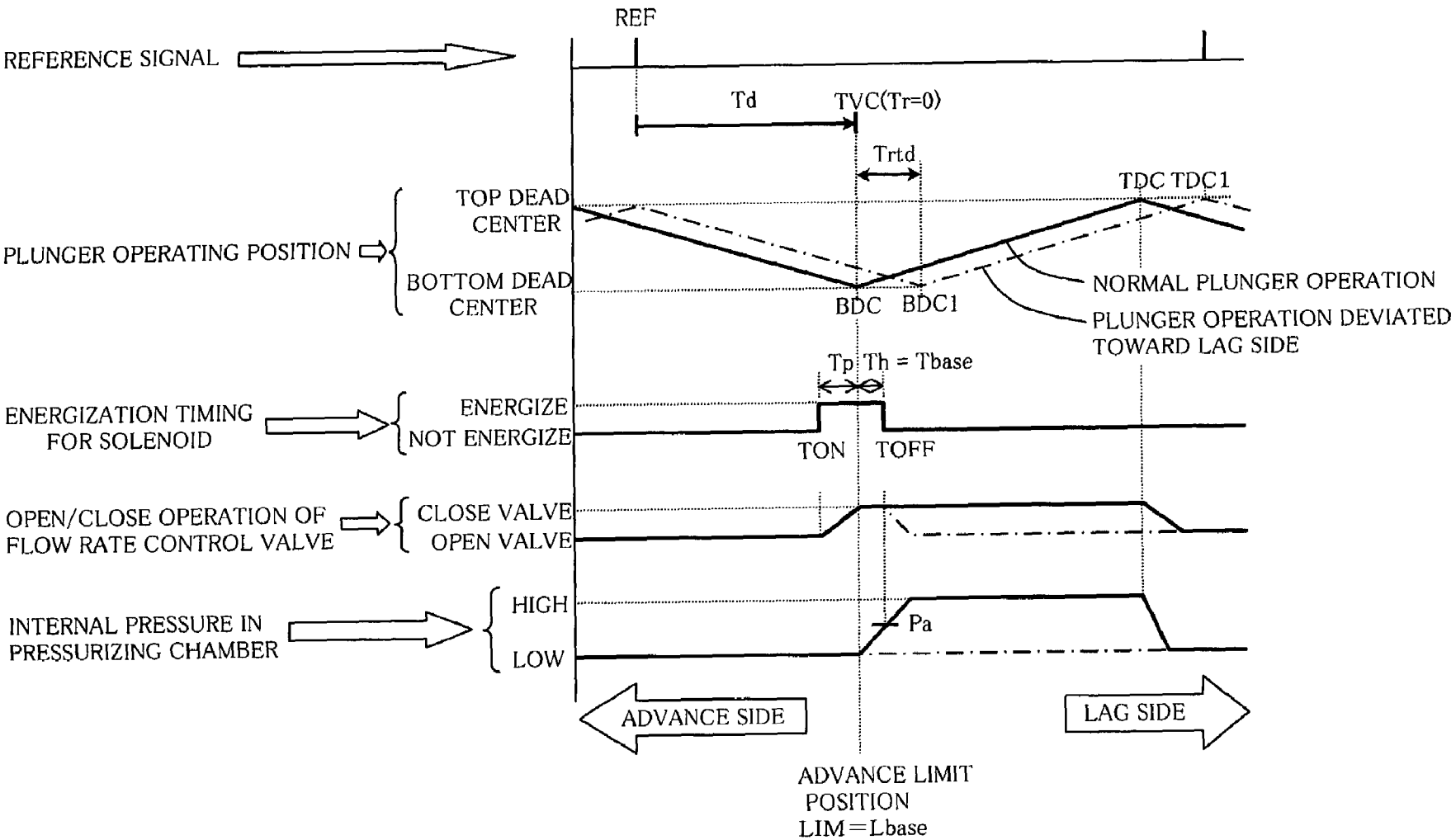
FIG. 15 is a fourth time chart illustrating a conventional problem.

In FIG. 10, as in the above-mentioned FIG. 15, since the advance limit value LIM is set at the same position Lbase as the estimated bottom dead center BDC, the target valve closing position TVC is allowed to advance up to the position of the advance limit value LIM=Lbase. In this case, in accordance with the above-mentioned FIG. 8, Th=Tbase+Trtd is set as the minimum necessary hold energization time.

When attempting to eject the maximum quantity of fuel, the target valve closing position TVC is controlled at the position of the advance limit value LIM=Lbase (i.e., Tr=0) by feedback correction. The energization of the solenoid is started at a time point TON preceding the time point of the target valve closing position TVC by the pre-energization time Tp. The energization of the solenoid is ended at a time point TOFF that is after the lapse of the hold energization time Th(=Tbase+Trtd) from the time point of the target valve closing position TVC.

As a result, even in the case where the plunger operating position has a maximum deviation toward the lag side (single-dotted chain line), the continuation of energization of the solenoid equivalent to the basic energization time Tbase after the actual bottom dead center BDC1 is secured. Thus, an improvement is made such that during the upward movement of the plunger from the actual bottom dead center BDC1 to the actual top dead center TDC1, the flow rate control valve is closed and the fuel sucked in the pressurizing chamber is supplied to the fuel rail.

The reason for expanding the advance limit value LIM to the position Ladv closer to the advance side than the estimated bottom dead center BDC is the achievement of the advantage shown in FIG. 12 as well, which will be described later.

Figure 12:
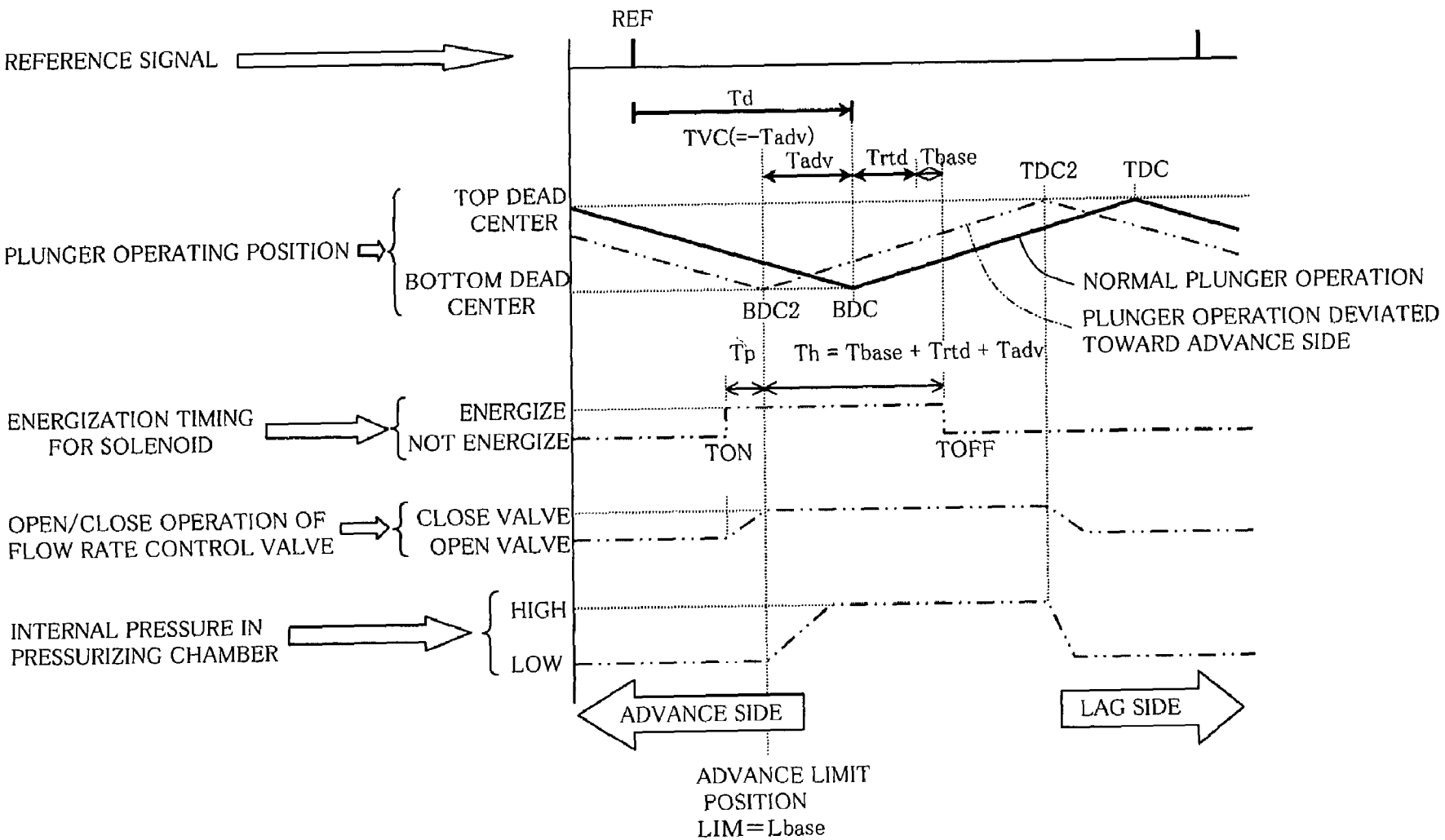
FIG. 12 is a third time chart illustrating an advantage of the invention according to Embodiment 1 of the invention, which is different from the first and second time charts.
Figure 16:
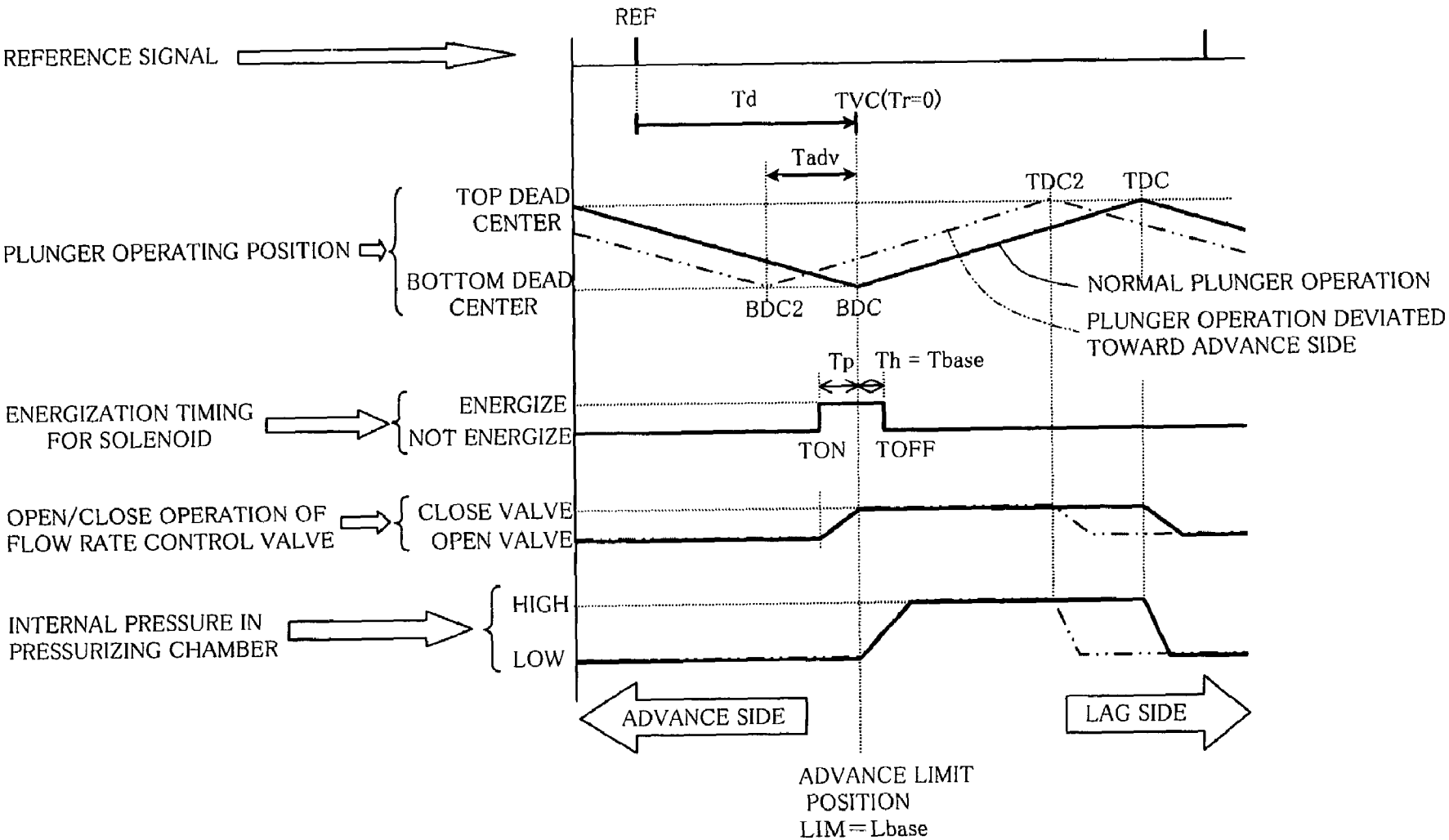
FIG. 16 is a fifth time chart illustrating a conventional problem, which is different from the fourth time chart.

FIG. 12 shows control operations according to this invention in the case where the plunger is operating at normal timing (solid line) and in the case where the plunger is operating with a maximum deviation toward the advance side (double-dotted chain line), as in the above-mentioned FIG. 16.

In FIG. 12, as in the above-mentioned FIG. 11, since the advance limit value LIM is set at the position Ladv closer to the advance side than the estimated bottom dead center BDC by the amount of Tadv, the target valve closing position TVC is allowed to advance up to the position of the advance limit value LIM=Ladv. In this case, in accordance with the above-mentioned FIG. 8, Th=Tbase+Trtd+Tadv is set as the minimum necessary hold energization time.

The target valve closing position TVC in performing ejection control of the maximum quantity of fuel is controlled at the position of the advance limit value LIM=Ladv (i.e., Tr=−Tadv) by feedback correction. The energization of the solenoid is started at a time point TON preceding the time point of the target valve closing position TVC by the pre-energization time Tp. The energization of the solenoid is ended at a time point TOFF that is after the lapse of the hold energization time Th(=Tbase+Trtd+Tadv) from the time point of the target valve closing position TVC.

As a result, even in the case where the plunger operating position has a maximum deviation toward the advance side (double-dotted chain line), the flow rate control valve is closed at the time point of the actual dead bottom center BDC2. Thus, an improvement is made such that during the period from the time point of the actual bottom dead center BDC2 to the time point of the actual top dead center TDC2, the maximum quantity of fuel pressurized in the pressurizing chamber is supplied to the fuel rail.

As described above, the hold energization time Th must be made longer than the basic energization time Tbase as described above, at least only when the target valve closing position TVC is controlled to be closer to the advance side than the actual bottom dead center BDC1 in the case where the plunger is operating with the maximum deviation Trtd toward the lag side.

Figure 13:
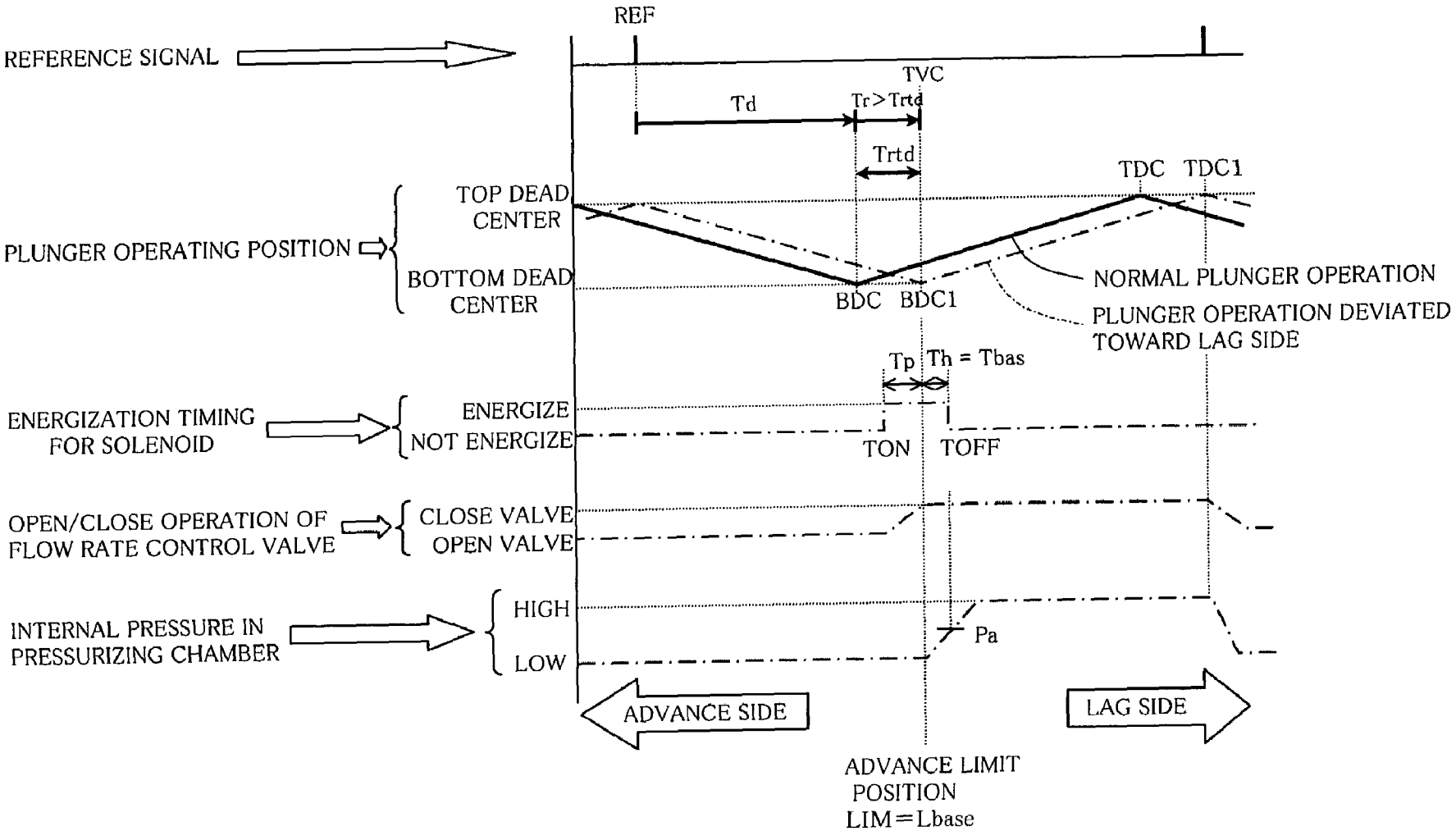
FIG. 13 is a time chart illustrating an advance of the invention according to Embodiment 2 of the invention.

Thus, according to the fourth and fifth aspects of the invention, when the target valve closing position TVC is controlled to be closer to the lag side than the plunger bottom dead center BDC1 in the case where the plunger is operating with the maximum deviation Trtd toward the lag side from the normal timing (that is, Tr>Trtd), the hold energization time Th is switched only to the minimum necessary time Tbase, like the solenoid energization timing shown in the time chart of FIG. 13, thus reducing the power consumption.

What is claimed is:

1. An energy-saving high-pressure fuel supply control device for internal combustion engine comprising: a high-pressure fuel pump that has a plunger driven to reciprocate by a pump cam interlocked with an internal combustion engine, sucks low-pressure fuel via a flow rate control valve during a movement of the plunger from a top dead center toward a bottom dead center, pressurizes the sucked fuel during a movement of the plunger from the bottom dead center toward the top dead center, and supplies the high-pressure fuel provided by the pressurization, to a fuel rail; and an electronic control unit that performs energization control to the flow rate control valve, wherein at a time point that is logically determined from the time point of the bottom dead center and when the pressure of the high-pressure fuel rises to a pressure to hold closing of the flow rate control valve, the electronic control unit ends the energization of the flow rate control valve to restrain energization energy to the flow rate control valve, wherein the time point when the energization of the flow rate control valve is ended is deviated toward a lag side in advance by a time that causes deviation of the bottom dead center of the plunger toward the lag side from the original bottom dead center.

2. An energy-saving high-pressure fuel supply control device for internal combustion engine comprising: a high-pressure fuel pump that has a plunger driven to reciprocate by a pump cam interlocked with an internal combustion engine, sucks low-pressure fuel via a flow rate control valve during a movement of the plunger from a top dead center toward a bottom dead center, pressurizes the sucked fuel during a movement of the plunger from the bottom dead center toward the top dead center, and supplies the high-pressure fuel provided by the pressurization, to a fuel rail; and an electronic control unit that performs energization control to the flow rate control valve, wherein at a time point that is logically determined from the time point of the bottom dead center and when the pressure of the high-pressure fuel rises to a pressure to hold closing of the flow rate control valve, the electronic control unit ends the energization of the flow rate control valve to restrain energization energy to the flow rate control valve, wherein the time point when the energization of the flow rate control valve is started is deviated toward advance side in an advance by a time that causes deviation of the bottom dead center of the plunger toward the advance side from the original bottom dead center.

3. An energy-saving high-pressure fuel supply control device for internal combustion engine comprising: a high-pressure fuel pump that alternately repeats suction of low-pressure fuel and ejection of high-pressure fuel to a fuel rail in accordance with operation of a plunger that reciprocates in a pressurizing chamber; a flow rate control valve that is arranged in a low-pressure path connecting the low-pressure fuel side to the pressurizing chamber and that is driven by energization of a solenoid; a target valve closing position deciding unit that decides a target valve closing position of the flow rate control valve; an advance setting limiting unit that limits the decision of the target valve closing position so as not to exceed a predetermined advance limit value toward advance side; a pre-energization time setting unit that sets a pre-energization time equivalent to an operation lag time from when the energization of the solenoid is started until the flow rate control valve is closed; a hold energization time setting unit that sets a hold energization time equivalent to a time period to continue the energization of the solenoid after the flow rate control valve is closed; and a flow rate control vale control unit that starts the energization of the solenoid at a time point preceding the time point of the target valve closing position by the pre-energization time and ends the energization of the solenoid at a time point that is after the lapse of the hold energization time from the time point of the target valve closing position, wherein the advance limit value is set at a position closer to the advance side than a plunger bottom dead center reaching position on the assumption that the plunger is operated with a maximum deviation toward a lag side from normal timing, in the case where a time from when the flow rate control valve is closed until the internal pressure in the pressurizing chamber rises to or higher than a pressure at which it acts as a physical energization force to close the flow rate control valve is defined as a basic energization time, and where a time difference between reaching timing of the plunger bottom dead center and reaching timing of the advance limit value on the assumption that the plunger is operated with the maximum deviation toward the lag side from the normal timing, is defined as a position deviation compensation time, the hold energization time is set to be a time at least equal to or longer than the sum of the basic energization time and the position deviation compensation time.

4. The energy-saving high-pressure fuel supply control device for internal combustion engine as claimed in claim 3, wherein the advance limit value is set at a position closer to the advance side than the plunger bottom dead center reaching position in the case the plunger is operating at the normal timing.

5. The energy-saving high-pressure fuel supply control device for internal combustion engine as claimed in claim 3, wherein the advance limit value is set at a position in the vicinity of the plunger bottom dead center reaching position on the assumption that the plunger is operating with a maximum deviation toward the advance side from the normal timing.

6. The energy-saving high-pressure fuel supply control device for internal combustion engine as claimed in claim 4, wherein the advance limit value is set at a position in the vicinity of the plunger bottom dead center reaching position on the assumption that the plunger is operating with a maximum deviation toward the advance side from the normal timing.

7. The energy-saving high-pressure fuel supply control device for internal combustion engine as claimed in claim 3, wherein when the target valve closing position is controlled to be closer to the lag side compared to the reaching position of the plunger bottom dead center on the assumption that the plunger is operating with a maximum deviation toward the lag side from the normal timing, the hold energization time is switched to a time that is shorter than the time equivalent to the sum of the basic energization time and the position deviation compensation time.

8. The energy-saving high-pressure fuel supply control device for internal combustion engine as claimed in claim 6, wherein when the target valve closing position is controlled to be closer to the lag side compared to the reaching position of the plunger bottom dead center on the assumption that the plunger is operating with a maximum deviation toward the lag side from the normal timing, the hold energization time is switched to a time that is shorter than the time equivalent to the sum of the basic energization time and the position deviation compensation time.

9. The energy-saving high-pressure fuel supply control device for internal combustion engine as claimed in claim 7, wherein when the target valve closing position is decided to be closer to the lag side than the reaching position of the plunger bottom dead center on assumption that the plunger is operating with a maximum deviation toward the lag side from the normal timing, the hold energization time is switched to a time that secures at least the basic energization time.

10. The energy-saving high-pressure fuel supply control device for internal combustion engine as claimed in claim 8, wherein when the target valve closing position is decided to be closer to the lag side than the reaching position of the plunger bottom dead center on assumption that the plunger is operating with a maximum deviation toward the lag side from the normal timing, the hold energization time is switched to a time that secures at least the basic energization time.

11. The energy-saving high-pressure fuel supply control device for internal combustion engine as claimed in claim 3, wherein the advance limit value is set at different values in accordance with the number of engine rotations.

12. The energy-saving high-pressure fuel supply control device for internal combustion engine as claimed in claim 10, wherein the advance limit value is set at different values in accordance with the number of engine rotations.

13. The energy-saving high-pressure fuel supply control device for internal combustion engine as claimed in claim 11, wherein the advance limit value is set at a value closer to the lag side when the number of engine rotations is larger than when it is smaller.

14. The energy-saving high-pressure fuel supply control device for internal combustion engine as claimed in claim 12, wherein the advance limit value is set at a value closer to the lag side when the number of engine rotations is larger than when it is smaller.

* * * * *